US010103494B2

(12) United States Patent
Cornelius et al.

(10) Patent No.: US 10,103,494 B2
(45) Date of Patent: Oct. 16, 2018

(54) CONNECTOR SYSTEM IMPEDANCE MATCHING

(71) Applicant: Apple Inc., Cupertino, CA (US)

(72) Inventors: William P. Cornelius, Saratoga, CA (US); Mahmoud R. Amini, Sunnyvale, CA (US); Zheng Gao, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/721,041

(22) Filed: Sep. 29, 2017

(65) Prior Publication Data

US 2018/0048094 A1 Feb. 15, 2018

Related U.S. Application Data

(63) Continuation-in-part of application No. 15/620,523, filed on Jun. 12, 2017, which is a continuation of application No. 14/706,997, filed on May 8, 2015, now Pat. No. 9,698,535.

(60) Provisional application No. 62/004,834, filed on May 29, 2014, provisional application No. 61/990,700, filed on May 8, 2014.

(51) Int. Cl.

| | |
|---|---|
| ***H01P 3/08*** | (2006.01) |
| ***H01P 5/08*** | (2006.01) |
| ***H01R 13/6469*** | (2011.01) |
| ***H01R 13/6473*** | (2011.01) |
| ***H01R 13/66*** | (2006.01) |
| *H01R 12/72* | (2011.01) |

(52) U.S. Cl.

CPC ..... *H01R 13/6469* (2013.01); *H01R 13/6473* (2013.01); *H01R 13/665* (2013.01); *H01R 12/721* (2013.01)

(58) Field of Classification Search

CPC ..... H01R 13/6469; H01R 13/6473; H01R 13/665; H01R 12/721; H01P 3/08; H01P 5/08; H01P 5/028

USPC ..... 439/620.2, 637, 636, 660, 638

See application file for complete search history.

(56) References Cited

U.S. PATENT DOCUMENTS 5,386,344 A 1/1995 Beaman
6,129,555 A 10/2000 Daikuhara
(Continued)

FOREIGN PATENT DOCUMENTS

JP 2005-531121 10/2005

OTHER PUBLICATIONS

Evaluation Report for Utility Model Patent (English Translation) dated Oct. 25, 2017 in Chinese Patent Application No. ZL2015900005501, 9 pages.

(Continued)

*Primary Examiner* — Harshad C Patel
(74) *Attorney, Agent, or Firm* — Kilpatrick Townsend & Stockton, LLP

(57) ABSTRACT

An electronic device including a universal serial bus type-C connector. The connector includes a first plurality of contacts and a second plurality of contacts. Each of the first plurality of contacts and each of the second plurality of contacts include a first layer formed of a first material and a second layer formed of a second material, the second layer over the first layer. The second layer is present in a first area of each of the first plurality of contacts and the second layer is absent from the first area of each of the second plurality of contacts.

19 Claims, 29 Drawing Sheets

(56) References Cited

U.S. PATENT DOCUMENTS 6,140,885 A * 10/2000 Abadeer ..... H04L 25/0278 327/333
6,425,766 B1 7/2002 Panella
6,600,339 B2 * 7/2003 Forbes ..... H04L 25/0282 326/30
6,787,888 B2 * 9/2004 Forbes ..... G11C 7/02 257/662
6,932,649 B1 8/2005 Rothermel
6,980,068 B2 * 12/2005 Miyazawa ..... H01P 1/047 333/246
7,235,457 B2 * 6/2007 Forbes ..... G11C 5/063 438/422
7,244,126 B2 7/2007 Morana
7,520,757 B2 4/2009 Bartholomew
7,625,215 B2 12/2009 Sawada
7,654,831 B1 2/2010 Wu
7,997,937 B2 8/2011 Kondo
8,063,316 B2 * 11/2011 Gorcea ..... H05K 1/0248 174/260
8,460,036 B1 6/2013 Chen et al.
8,727,809 B2 5/2014 Mongold
2001/0000428 A1 * 4/2001 Abadeer ..... H04L 25/0278 333/33
2003/0180011 A1 9/2003 Aronson
2004/0229510 A1 11/2004 Lloyd
2005/0059296 A1 3/2005 Wang
2005/0062556 A1 * 3/2005 Aronson ..... H01R 23/688 333/33
2005/0118876 A1 6/2005 Niitsu et al.
2005/0140462 A1 * 6/2005 Akram ..... H01L 23/5225 333/33
2005/0260872 A1 11/2005 Bassler et al.
2008/0028941 A1 2/2008 Kunga
2009/0221165 A1 9/2009 Buck
2010/0203768 A1 8/2010 Kondo et al.
2011/0140799 A1 * 6/2011 Biran ..... H01P 3/121 333/26
2011/0201234 A1 8/2011 Long
2013/0106528 A1 * 5/2013 Christian ..... H05K 1/0251 333/33
2013/0309906 A1 11/2013 De Geest
2013/0316581 A1 11/2013 Kao et al.
2013/0330976 A1 12/2013 Simmel et al.

OTHER PUBLICATIONS

International Search Report for International PCT Application No. PCT/US2015/029994, dated Aug. 18, 2015, 3 pages.
"High Permeability Materials", Microwaves101.com [online], [retrieved on Sep. 29, 2017]. Retrieved from the Internet <URL: https://www.microwaves101.com/encyciopedias/high-pemeability-materials>, 3 pages.
Notice of Allowance dated Jan. 26, 2018 in U.S. Appl. No. 15/620,523, 11 pages.

* cited by examiner

CONNECTOR SYSTEM IMPEDANCE MATCHING

CROSS REFERENCE TO RELATED APPLICATIONS

The present application is a continuation-in-part of U.S. patent application Ser. No. 15/620,523, filed Jun. 12, 2017, which is a continuation of U.S. patent application Ser. No. 14/706,997 filed May 8, 2015, which claims the benefit of U.S. provisional application No. 61/990,700, filed May 8, 2014, and 62/004,834, filed May 29, 2014, which are incorporated by reference.

BACKGROUND

The amount of data transferred between electronic devices has grown tremendously the last several years. Large amounts of audio, streaming video, text, and other types of information content are now regularly transferred among desktop and portable computers, media devices, handheld media devices, displays, storage devices, and other types of electronic devices.

Data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices to form pathways for data and power.

These connector inserts may include contacts or pins that form signal paths with contacts or pins in the corresponding connector receptacles. It may be desirable that these signal paths have a matched impedance over their lengths in order to increase the data rate that the signal path can support. That is, it may be desirable that these signal paths appear as transmission lines having a specific impedance. These transmission lines may convey signals that are substantially free of reflections, rise and fall time distortions, and other artifacts that may slow data transfers. Such transmission lines may be capable of handling higher data transmission rates than a signal path that does not have a matched impedance. This may be particularly important for large data transfers.

New generations of electronic devices are consistently becoming thinner and smaller. This reduction in device thickness has led to connector systems having a reduced height. This results in individual connector system components becoming thinner as well. Unfortunately, as these components become thinner, it may become harder to maintain the desired impedance along these signal paths.

Thus, what is needed are connector inserts and receptacles that provide signal paths having desired impedance characteristics.

SUMMARY

Accordingly, embodiments of the present invention may provide connector inserts and receptacles that provide signal paths having desired impedance characteristics. An illustrative embodiment of the present invention may provide a connector system having a connector insert and a connector receptacle. Contacts in the connector insert may form electrical paths with corresponding contacts in the connector receptacle. These electrical paths may be used as signal paths, power paths, or other types of electrical paths, but may be referred to here as signal paths for simplicity. Additional traces in the connector insert and receptacle may be part of these signal and power paths.

The signal paths may have a target or desired impedance along their lengths such that the signal paths electrically appear as transmission lines. Constraints on physical dimensions of the connector insert and connector receptacle contacts may result in variations in impedance along the signal paths. Accordingly, embodiments of the present invention may provide structures to reduce these variations in impedance. Other embodiments of the present invention may provide structures to compensate for these variations, or structures may be provided to reduce and compensate for these variations in impedance. It should be noted that the impedances described here are impedances at a frequency, for example, the signal frequency or a frequency component of signals conveyed by these signal paths.

In one illustrative embodiment of the present invention, a connector insert may include spring finger contacts. These contacts may engage corresponding surface contacts on a connector receptacle tongue when the connector insert is inserted into the connector receptacle. Traces in or on the tongue may be used to route signals to and from the connector receptacle contacts. Signal paths in this connector system may include the spring finger contacts in the connector insert and the contacts and traces in and on the tongue of the connector receptacle.

These signal path impedances may have various errors or fluctuations along their lengths. For example, a contact in the connector insert may be located above or below a ground plane, where the ground plane is located along a center line of the connector insert. The contact may have a capacitance to the ground plane, where the capacitance increases with the proximity of the contact to the ground plane. Since impedance is inversely proportional to the square root of the capacitance, when the contact is closer to the ground plane, the impedance may decrease. Keeping the spacing between the contact and ground plane relatively constant may allow the impedance to be well controlled along the contact's length, but there may be a discontinuity where the insert contacts extend beyond the ground plane and housing. The nearest ground or fixed potential may be further away at this point, leading to an increase in impedance in the signal path at that point. Conversely, the size of receptacle contacts needed to provide a wiping function and to reliable engage the insert contacts may lead to an increase in capacitance and a resulting decrease in impedance at that point. Also, excess portions of the connector insert and receptacle contacts may create stubs, which may act as capacitors, thereby further reducing the impedance at the connector receptacle contact.

These and other embodiments of the present invention may reduce or at least partially compensate for these and other impedance errors. In one example, the ground plane in the connector insert may extend such that it engages or contacts a corresponding ground plane in a connector receptacle. The continuous ground plane may help the common mode impedance.

In these and other embodiments of the present invention, the decrease in impedance near the connector receptacle surface contacts may be reduced. For example, signal contacts having a reduced depth may be provided. These reduced depth contacts may have an increased distance to a center ground plane in the tongue. The increased distance may reduce coupling capacitance, thereby increasing local impedance. In this and other embodiments, power contacts may be deeper or thicker to provide an increase in current handling capability.

In other illustrative embodiments of the present invention, the ground plane may be thinned below the signal contacts to further increase a distance between a signal contact and the ground plane. In still other illustrative embodiments of the present invention, the ground plane may have openings below the signal contacts. While this may allow cross-talk between signal contacts on a top and bottom of the connector receptacle tongue, the impedance error may be reduced enough to provide an overall improvement in performance. In these and other embodiments, the traces may be offset from each other to reduce this crosstalk.

In this and other embodiments of the present invention, a ground plane may reside near a center of the tongue. In other embodiments of the present invention, the central plane may be a power plane. Other planes may be located above or below these central planes. Again, these may be power or ground planes. For example, a power plane may be centrally located and ground planes may be positioned above and below the central plane. A high capacitance dielectric may be placed between the power and ground planes in order to form bypass capacitors between power and ground. This capacitance may help to reduce the return path impedance and may help to reduce power supply noise. For example, a dielectric having a dielectric constant or relative permittivity on the order of 100 to 1,000 or higher may be used. In these and other embodiments of the present invention, a discrete capacitor may be used. This discrete capacitor may include multiple alternating power and ground terminals and may be located between these power and ground planes. In these and other embodiments of the present invention, these capacitors may be in a tongue of a connector receptacle, or elsewhere in a connector receptacle or connector insert.

In the above embodiments of the present invention, impedance errors may be reduced. In these and other embodiments of the present invention, the above impedance errors may be compensated for. For example, traces connected to contacts on the connector receptacle tongue may be arranged to provide higher or lower impedances than the desired impedance of the signal paths in order to compensate for the above, and other, impedance errors. In an illustrative embodiment of the present invention, a distance between these traces and a ground plane may be varied, for example from tens of microns to hundreds of microns, in order to adjust the impedance of a portion of a trace in a tongue. This impedance may be set such that the average or effective impedance for the overall signal trace meets a desired specification or target. This averaging effect may be effective when the delay through these traces is short compared to a rise and fall time of the signals propagating through the traces.

In still other embodiments of the present invention, the arrangement of these traces may be varied to construct a distributed element filter. For example, the width of traces in a signal pair, a distance or spacing between traces in a signal pair, as well as distances between these traces and a ground plane may be varied in a receptacle tongue. Also, a material that the tongue or other connector portions are made of may be varied or removed in order to change a dielectric constant or permittivity between or among traces, contacts, ground planes, and other structures. These variations may result in different common-mode impedances for the signal path pair along various sections of the traces. In various embodiments of the present invention, differential-mode impedances may remain at least approximately constant among multiple of these sections. These sections having different common-mode impedances may be arranged to form a common-mode filter to filter or reduce common-mode energy in signals conveyed along the signal path. That is, the signal path pair may be used to convey a differential signal, and the variance of the common-mode impedance may be used to form an in-line filter to remove common-mode energy from the differential signal pair. For example, a choke, notch, low-pass, high-pass, band-pass, or other type filter may be formed. These and similar techniques may be used to filter power supplies as well, for example by forming a common-mode low-pass or choke filter.

Again, in illustrative embodiments of the present invention, parameters and dimensions of traces and other structures on a tongue may be varied to change impedances. These impedances may include a single-ended impedance, which may be the impedance of a contact or trace to ground. These impedances may also include a common-mode impedance, which may be the impedance between a pair of contacts and traces to ground, and a differential-mode impedance, which may be the impedance between a pair of contacts or traces to each other.

These impedances may be varied in several ways in embodiments of the present invention. For example, traces may be made wider, narrower, thicker, thinner, closer to each other, and farther apart. They may be thinned or thickened. The dielectric between them may be varied. Holes may be formed in the dielectric or conductive material and structures.

These different techniques may be employed by various embodiments of the present invention to accomplish various goals. For example, in small connectors, the small geometries may result in large capacitances between a signal trace or contact and ground. This may result in a low impedance to ground at the signal frequencies. These various techniques may be used by embodiments of the present invention to increase signal path impedance to ground. Also, common-mode and differential-mode impedances may be varied among different sections of traces or interconnect in a connector. These impedances may be arranged to form distributed element filters along these traces.

These different techniques may be used to increase or otherwise adjust an impedance of a signal path. In an illustrative embodiment of the present invention, a pair of traces may be formed on a plastic tongue. Material may be removed from sections of the area between the traces on the tongue. This may act to decrease the dielectric constant or permittivity between the traces in these sections, thereby increasing the impedance. In another illustrative embodiment of the present invention, this material may be removed from an area between contacts or traces and a center ground plate of the connector. Again, this may act to decrease the dielectric constant or permittivity between the traces in these sections, thereby increasing the impedance. This material may be removed in relatively large sections. In other embodiments of the present invention, micro-perforations or other sized perforations, in either or both the material between the traces and a ground plane or in the ground plane itself, may be used to increase impedance. In these and other embodiments of the present invention, these perforations may be formed on the contacts themselves. These perforations may form a photonic bandgap, which may also be used as a filter element. In other embodiments of the present invention, one or more sections of a center ground plane may have a raised or lowered section below one or more contacts to lower or raise an impedance at the contact.

Common-mode and differential-mode impedances may be varied among different sections of traces or interconnect in a connector. These impedances may be arranged to form distributed element filters along these traces. Other structures, such as open ended or shorted stubs may be included in these filters. In an illustrative embodiment of the present invention, traces may be arranged such that a common-mode impedance may be varied among different sections of a pair of the traces. This may be used to form a common-mode filter that may block common-mode currents and reduce electro-magnetic interference. The traces may also be arranged such that a differential-mode impedance may be held relatively constant among the sections. Accordingly, this filter may provide limited differential filtering and may have only a limited effect on a differential signal conveyed on the traces. In this way, common-mode impedances may be varied along a trace, while a differential-mode impedance may remain relatively constant along the trace. These sections may be arranged using distributed element filter and transmission filter techniques to form filters to block common-mode signals while allowing differential-mode signals pass.

In these and other embodiments of the present invention, ground and power supply connections between a connector insert and a connector receptacle may form loops that traverse the interface between the connector insert and the connector receptacle. These loops may include contacts and traces in the connector insert and the connector receptacle. These loops may form stray or parasitic inductances and capacitances. These inductors and capacitors may include tank circuits that may oscillate during device operation. Such oscillations may occur at very high frequencies and may cause cross-talk and electromagnetic interference.

In these and other embodiments of the present invention, these oscillations may be reduced or otherwise mitigated by inserting series resistances in the loops. These series resistance may be resistances of ground, power, or other contacts in either or both the connector insert or connector receptacle. The resistance of these contacts may be increased in various ways in various embodiments of the present invention. For example, plating layers, such as a gold or other low-resistance layers may be omitted from all or a portion of a contact. In these and other embodiments of the present invention, a contacting surface of a contact may be plated with a high permeability material, such as nickel, with a gold plated overlay to reduce impedance. A remainder of the contact might not be gold plated, thereby exposing the nickel plating on those portions. This absence of gold plating may increase the resistance of a parasitic tank circuit due to the high permeability of nickel. More specifically, since the skin depth is very shallow for high frequency signals (for example, 0.05 microns at 10 GHz), then this shallow skin depth may increase the impedance at frequency (for example, 15 ohms series resistance.) This may reduce the quality factor (or Q), which may reduce the peak energy in any resonance, thereby reducing cross-talk and electromagnetic interference. In these and other embodiments of the present invention, one or more higher-resistance layers may be plated over all or a portion of a contact. This higher-resistance layer may similarly help to reduce cross-talk and electromagnetic interference. While nickel and gold are shown here in this example, in these and other embodiments of the present invention, other platings with a high permeability that provide the desired series impedance may be used. That is, various materials with a high permeability (ability to conduct magnetic fields), such as nickel, iron, or other material may be used. This material may also have a low resistance or impedance at low frequencies (ability to conduct electricity.) However, due to their high permeability, these materials may have a shallow skin depth, thereby increasing their impedance at frequency. In these and other embodiments of the present invention, a high permeability material may be overlaid or plated with a low impedance material. In these and other embodiments of the present invention, gold may be absent or omitted from an area of a signal pin to increase the series impedance, while gold may be present in the same area in power and ground contacts.

In these and other embodiments of the present invention, a signal strength in a signal path may be modified to improve signal-to-noise ratios in one or more nearby or adjacent signal paths. For example, a first signal path may provide signals having a large amplitude while a second signal path may provide signals having a smaller amplitude. These signal paths may couple to each other. The first signal path may have a good signal-to-noise ratio due to its high signal strength and the limited noise contribution coupled from the second signal path, while the second signal path may have a poorer signal-to-noise ratio due to its low signal strength and the larger noise contribution coupled from the first signal path. The signal strength of the first signal path may be reduced in response to this imbalance. This may reduce the signal-to-noise ratio in the first path due to the diminished signal amplitude. This may be justified by the improved signal-to-noise ratio in the second signal path due to the decreased noise contribution coupled from the first signal path. For example, a dual simplex link may use a connector to couple signals traveling in both directions across the link. This connector may be a principle source of coupling between signals. These and other embodiments of the present invention may modify one or more signal strengths such that the signals have similar amplitudes at points of highest coupling in the connector. This may help to preclude a strong signal from coupling onto a weak signal and thereby lowering the weak signals bit-error rate (BER). In these and other embodiments of the present invention, either the loss on each transmitter from the transmitter to the connector coupling point may be balanced, or the transmitted strength of the stronger signal at the connector coupling point may be reduced so that signal strength at the point of coupling is equalized for each signal. This may result in a balanced signal-to-noise ratio for each signal, and may optimizes the lowest signal-to-noise ratio. This may improve the signal-to-noise ratio for the weaker signal, which may otherwise limit overall link performance.

In these and other embodiments of the present invention, the signal strength may be determined using amplitude or eye height, eye width, eye opening, or other signal characteristic. In these and other embodiments of the present invention, a first electronic device receiving a signal may provide amplitude information about the received signal to a second electronic device, where the second electronic device may adjust a signal amplitude in one or more channels.

Again, in these and other embodiments of the present invention, a ground plane in the connector insert may extend or otherwise be located such that it engages or contacts a corresponding ground plane in a connector receptacle. These ground planes may be formed of various materials. For example, they may be made of ferritic material or material with high permeability, or they may include, nickel or other material that is at least fairly resistive at high frequency due to skin depth effect in order to reduce coupling currents in the ground plane. They may also be formed of ferrite or other material that is both highly resistive (at least at high frequencies), due to skin depth at high frequency, and magnetically conductive. The ground planes may include protrusions or other contacting surfaces or other contacting surfaces or structures to mate the two ground planes.

In these and other embodiments of the present invention, instead of (or in conjunction with) forming a connection between ground planes in the connector receptacle tongue and a ground plane in a connector insert portion, a front edge of connector insert portion and a front edge of a connector receptacle tongue may be plated with a high permeability material. This material may be plated with a high permeability material having a low skin depth to provide a high impedance at high frequencies. Again, these edges may be connected to ground planes in a connector insert portion and to a ground plane in a connector receptacle tongue. This plating may lower the quality or Q of a slot-transmission line that may be formed when the connector receptacle and connector insert are mated. That is, when the connectors are mated, a gap between front edges of a connector receptacle tongue and a connector insert portion may form a slot-transmission line. This gap may be open on each end and thus may resonate at frequency that is half a wavelength of the slot length. The low skin depth of the front edge plating may make the gap resistive at high frequency. This may lower the Q, which may lessen the coupling energy crossing slot-transmission line on the signal pins, which may reduce coupling among the signal pins. In these and other embodiments of the present invention, the high permeability material may be nickel, iron, or other material.

In these and other embodiments of the present invention, an impedance between ground and one or more power supplies, bias voltages, or other voltages may be reduced in order to make the power and ground conductors effective return paths for radio frequency signals. In various embodiments of the present invention this may be done by forming ground and power planes in parallel in connectors, for example in a tongue of a connector receptacle. Capacitors may be placed between these planes, between a contact and a plane, or elsewhere in a connector or connector tongue. For example, one or more capacitors may be physically located between a power supply contact and a ground plane. Trace length between the ground and power supply contacts and the planes may be reduced to further decrease loop energy.

These and other embodiments of the present invention may provide high-speed transmitters and receivers capable of maintaining high data rates. These high-speed transmitters and receivers may be used to convey lower-speed signals in an efficient manner. Specifically, parallel lower-speed data signals may be interleaved or multiplexed and then transmitted using the high-speed transmitters and receivers. This may allow the same data to be conveyed using fewer transmitters, receivers, conductors, and other components. In one example, DisplayPort data may be received at a first connector insert, where the first connector insert is inserted into a first electronic device (a source.) The DisplayPort data may include four lower-speed, differential data signals. These four signals may be received by circuitry in the connector insert, and pairs of data signals may be serialized by a parallel-to-series converter. The two resulting two serialized data signals may be transmitted through a cable to a second connector insert, where the second connector insert is inserted into a second electronic device (a sink.) The serialized data may be converted back to parallel data. The four resulting parallel signals may then be provided to the second electronic device.

These and other embodiments of the present invention may use pins with low frequency content (for example, low frequency signal, power, or ground) to couple high frequency signals (for example, using a di-plexer) to one or more pins of a data interface to provide additional paths for data signals. For example, in the USB type-C interface, there are pins for providing power to connector inserts (SBU1 and SBU2), connection detection pins (CC1 and CC2), as well as two pairs of USB pins (D+ and D−). Some or all of these pins may be used to provide high-speed data. For example, four adjacent pins along a top or bottom of a USB type-C connector may be used to convey high-speed signals. In these and other embodiments of the present invention, different numbers of these pins may be repurposed to convey data.

These and other embodiments of the present invention may provide this repurposing by providing alternative modes of operation for these pins. In one example, USB data pins may be repurposed by connecting a high-speed data path to the USB data pins. The high-speed data path may include pin diodes that may disconnect the high-speed data path when the USB pins are not being repurposed. When conventional USB signals are received, a switch may close and USB data may pass through an isolation component to a USB receiver. When the USB pins are repurposed, the pin diodes may be biased to conduct the higher-speed signals. The switches may open, disconnecting the USB path. The isolation components may prevent stubs from forming in the high-speed data path, allowing for a higher-speed operation. Alternatively, a multiplexer that may support the data rates and the required voltage swings may be employed to alternate between USB2 modes and these higher speed modes.

While embodiments of the present invention may be used with connector systems having spring finger contacts in the insert and surface contacts on a tongue in the receptacle, other embodiments of the present invention may provide connector systems where the receptacle includes spring finger contacts and the insert includes a tongue supporting a number of contacts. In still other embodiments, a tongue may be in either, both, or neither the insert and receptacle, and various types of contacts may be employed in the insert and receptacle.

The connector receptacle tongues employed by embodiments of the present invention may be formed in various ways of various materials. For example, the tongue may be formed using a printed circuit board. The printed circuit board may include various layers having traces or planes on them, where the various traces and planes are connected using vias between layers. The printed circuit board may be formed as part of a larger printed circuit board that may form a logic or motherboard in an electronic device. In other embodiments of the present invention, these tongues may be formed of conductive or metallic traces and planes in or on a nonconductive body. The nonconductive body may be formed of plastic or other materials.

In various embodiments of the present invention, contacts, ground planes, traces, and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or layered material of each type or other material. The nonconductive portions may be formed using injection or other molding, 3-D printing, machining, or other manufacturing process. The nonconductive portions may be formed of rubber, hard rubber, plastic, nylon, liquid-crystal polymers (LCPs), or other nonconductive material or combination of materials. The printed circuit boards used may be formed of FR-4, BT or more generally fiber glass materials or fiber free printed circuit board material or other material such as plastic or hybrid structures. Printed circuit boards may be replaced by other substrates, such as flexible circuit boards, in many embodiments of the present invention.

Embodiments of the present invention may provide connectors that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connectors may provide pathways for signals that are compliant with various standards such as Universal Serial Bus (USB) including USB-C, High-Definition Multimedia Interface® (HDMI), Digital Visual Interface (DVI), Ethernet, DisplayPort, Thunderbolt™, Lightning™ Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connectors that may be used to provide a reduced set of functions for one or more of these standards. In various embodiments of the present invention, these interconnect paths provided by these connectors may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
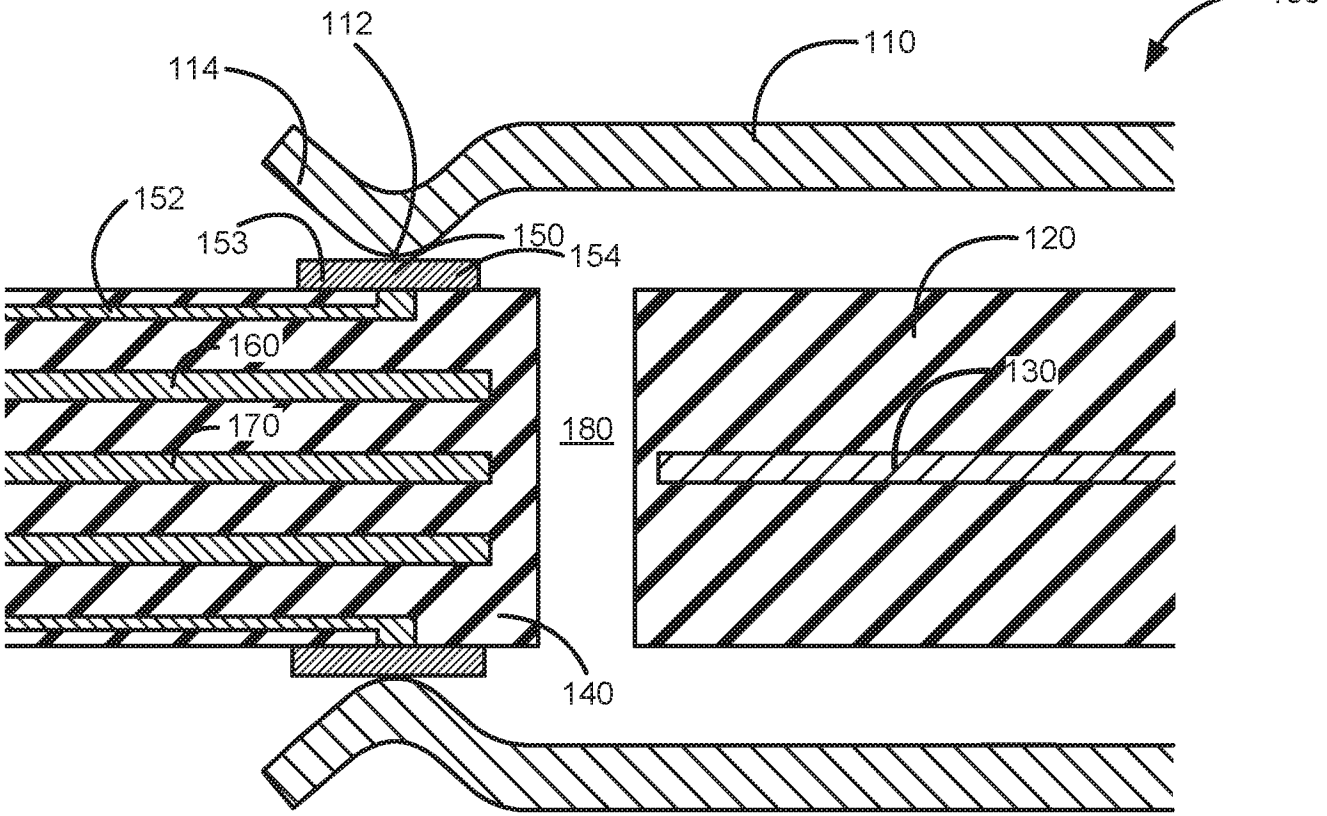
FIG. 1 illustrates a connector system according to an embodiment of the present invention.

FIG. 1 illustrates a connector system according to an embodiment of the present invention. This figure, as with the other included figures, is shown for illustrative purposes and does not limit either the possible embodiments of the present invention or the claims.

In this figure, a portion of a connector insert has been inserted into a connector receptacle. Shown are connector insert contacts 110 supported by connector insert housing 120. Connector insert contacts 110 may electrically connect to conductors in a cable (not shown.) A central ground plane 130 may be located in connector insert housing 120 and may be connected to the cable as well. The connector insert may be inserted into a connector receptacle including tongue 140. Tongue 140 may support a number of contacts 150. Traces 152 may electrically connect contacts 150 to circuitry inside a device housing tongue 140. Tongue 140 may further include one or more planes 160 and 170. Planes 160 and 170 may be power supply, ground, or other types of planes. For example, plane 170 may be a power supply plane having ground plane on a top and bottom side.

In this example, signals may propagate along contacts 110 until they reach contact point 112. The signals may then propagate through contacts 150 and traces 152. Conversely, signals may propagate in the other direction, through traces 152 to contacts 150, through contact point 112 and through connector insert contact 110.

Again, it may be desirable that this signal path have a matched impedance along its entire length. For example, it may be desirable that this signal path have a 50 ohm, 85 ohm, 110 ohm, or other specific impedance along its entire length. Unfortunately, aspects of these paths may create impedance errors, variations, or fluctuations along their lengths. These errors may cause reflections and signal distortions that may reduce the data rates that would otherwise be achievable.

Accordingly, embodiments of the present invention may mitigate or reduce these errors. In this way, signals may be distorted to a lesser degree such that sufficiently high data rates are still achievable. For example, impedance errors may be limited resulting in signal rising and falling edges that may be distorted to a limited degree such that high data rates are possible. These and other embodiments may compensate for, or at least somewhat cancel, these errors. In this way, signals may be distorted in ways that cancel each other out such that significantly high data rates are still achievable. For example, signal rising and falling edges may be distorted in ways the cancel each other out such that high data rates remain possible. Some of the sources of these impedance errors, as well as both reduction and cancellation strategies for them are shown in the following figures.

Figure 2:
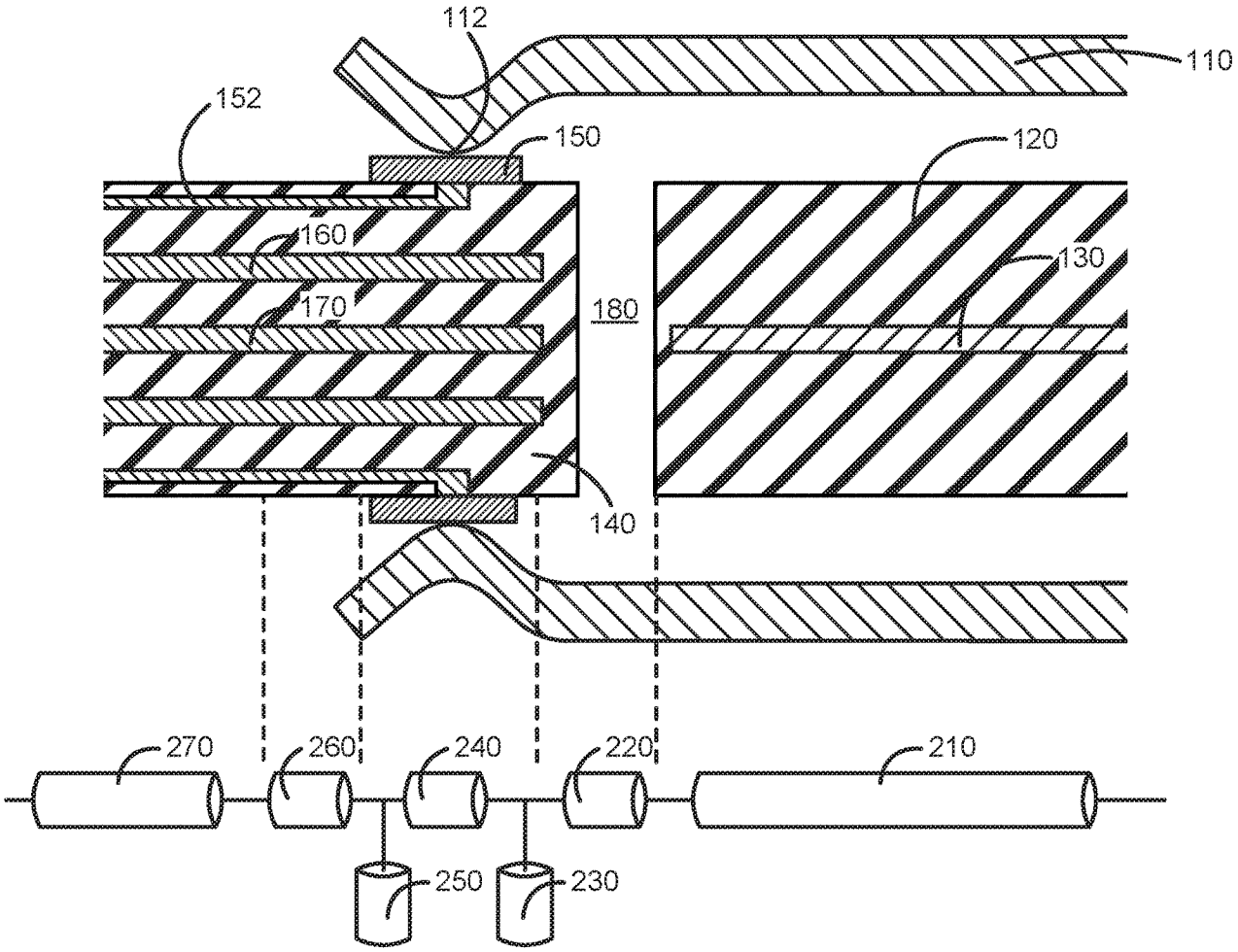
FIG. 2 illustrates a transmission line model for a signal path in the connector system of FIG. 1.

FIG. 2 illustrates a transmission line model for a signal path in the connector system of FIG. 1. In this example, a length of connector insert contact 110 over central ground plane 130 in the connector insert may be modeled as transmission line 210. A spacing between connector insert contact 110 and ground plane 130 may be sufficiently large and well-controlled that transmission line 210 may have a characteristic impedance very near a desired level.

As connector insert contact 110 extends beyond housing 120, it may reach an open area or spacing 180 between housing 120 and a connector receptacle tongue 140 in the connector receptacle. Transmission line 220 may be used to model this length. The characteristic impedance of transmission line 220 may be higher than desired since ground plane 130 may be absent below connector insert contact 110. In this and the other examples, an impedance may be increased by increasing an inductance, decreasing a capacitance, or both. Similarly, an impedance may be decreased by decreased an inductance, increasing a capacitance, or both.

At point 112, connector insert contact 110 may engage corresponding contact 150 on tongue 140 of the connector receptacle. The portion of the signal path may be modeled by transmission line 240. Extraneous edges and portions of connector insert contact 110 and connector receptacle contact 150 may be modeled as transmission line stub portions 230 and 250. Specifically, portion 114 of contact 110 and portions 153 and 154 of contact 150, and others, may be modeled as transmission line stub portions 230 and 250. These transmission lines stubs may act as capacitors to reduce the characteristic impedance along this length.

After reaching contact 150, signals may be routed through traces 152. Traces 152 may have various sections, modeled here as transmission lines 260 and 270.

Figure 3:
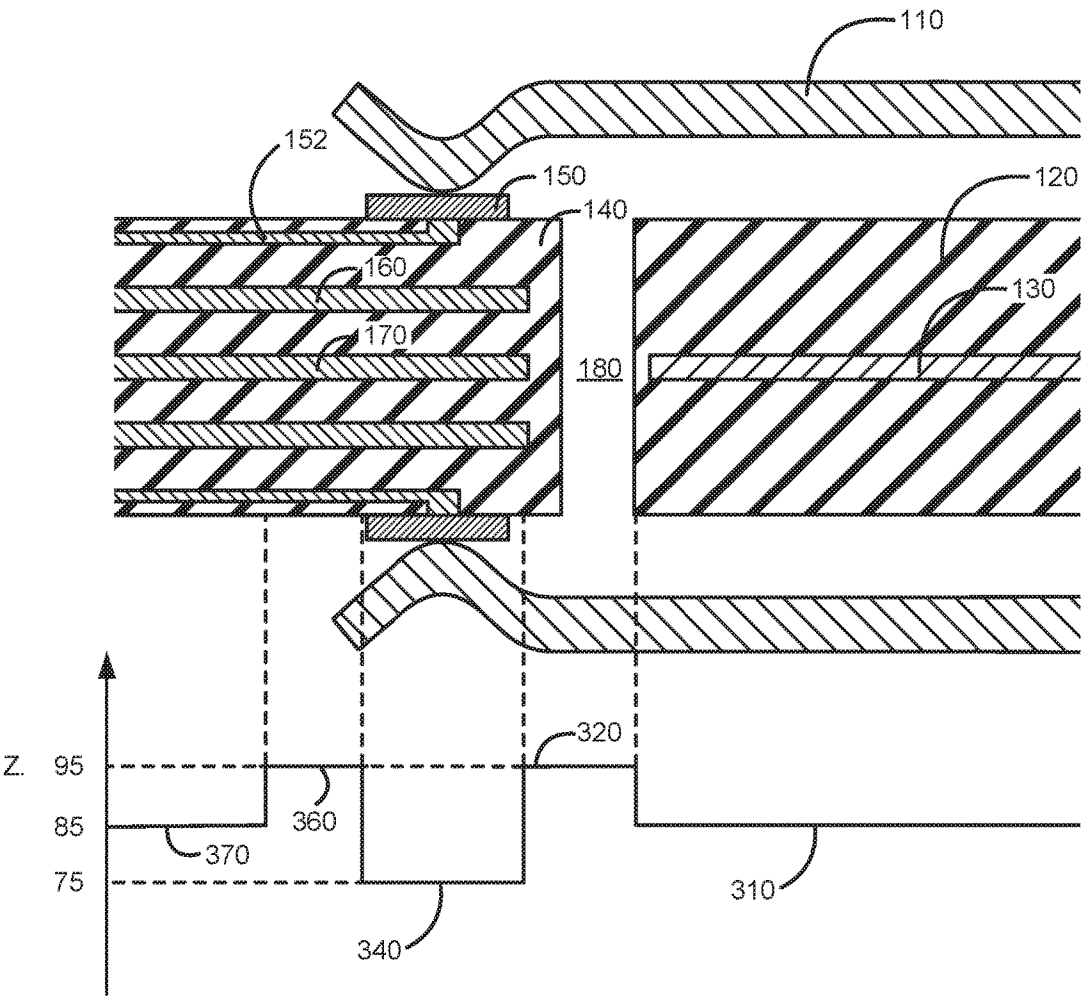
FIG. 3 illustrates an example of the variation in impedance along a signal path for the connector system of FIG. 1.

FIG. 3 illustrates an example of the variation in impedance along a signal path for the connector system of FIG. 1. Again, where connector insert contact 110 is above ground plane 130 and housing 120 of the connector insert, the characteristic impedance 310 may be very near a desired impedance level, shown here as 85 ohms. Where ground plane 130 is absent below contact 110, the impedance 320 may rise, in this example to 95 ohms. Further along, stub portions of the contacts may reduce impedance. In this example, the resulting impedance 340 may be shown as 75 ohms.

The relative lengths and impedance of transmission lines 220 and 240 may determine whether the overall impedance of the signal is higher or lower than desired. In this example, the lengths and impedances are shown as causing the signal path impedance to be low. To compensate for this, the impedance 360 may be purposefully raised, for example to 95 ohms. Similarly, its length may be adjusted to provide a correct amount of increase in impedance. A remaining portion of traces 152 may be at or near the nominal impedance of 85 ohms. In this way, the total average or effective impedance of the signal path may be adjusted to the desired level.

In this example, the impedance 310 may correspond to the characteristic impedance of transmission line 210, impedance 320 may correspond to the characteristic impedance of transmission line 220, the impedance 340 may correspond to the characteristic impedance of transmission line 240 and transmission line stub portions 230 and 250, the impedance 360 may correspond to the characteristic impedance of transmission line 260, while impedance 370 may correspond to characters impedance of transmission line 270 in FIG. 2.

In this and other embodiments of the present invention, one or more connector insert contacts 110 may be ground or power contacts. Contacts 150 on tongue 140 may directly connect to one of the planes 160 or 170, for example through a via or other interconnect structure. This direct connection may reduce the effect of transmission line components 250, 260, and 270. This may improve the impedance of the ground or power contacts. It may also reduce loop currents that may otherwise cause connector suckout. The width and length of the via may be varied to adjust an inductance of the direct connection. This inductance may be tuned to compensate for one or more of the capacitances associated with transmission lines 210, 220, 230, 240, or other capacitance. That is, a peaking or gain provided by the inductor may be used to cancel or reduce a dip or attenuation caused by one or more of the capacitances associated with transmission lines 210, 220, 230, 240, 250, 260, 270, or other capacitance.

Similar techniques may be used on contacts 110 that are not power or ground contacts. That is, inductances, for example formed using vias, may be inserted in the signal path on tongue 140. These inductances may be tuned to provide a peak that cancels or reduces a dip or attenuation caused by one or more of the capacitances associated with transmission lines 210, 220, 230, 240, or other capacitance.

In one example, spacing 180 may be increased in order to make transmission line 220 more inductive and have a higher impedance to compensate for the capacitances caused by transmission line stubs 230 and 250. An increase in spacing 180 may cause an increase in crosstalk between contacts 110 on opposite sides of the connector insert, so there may be a limit on how big this spacing 180 may be made.

Again, embodiments of the present invention may reduce these various errors in order to limit signal distortions through these paths. These and other embodiments of the present invention may compensate or attempt to reduce or cancel a total error through the signal path. Examples of structures used to reduce impedance errors are shown in the following figures.

Figure 4:
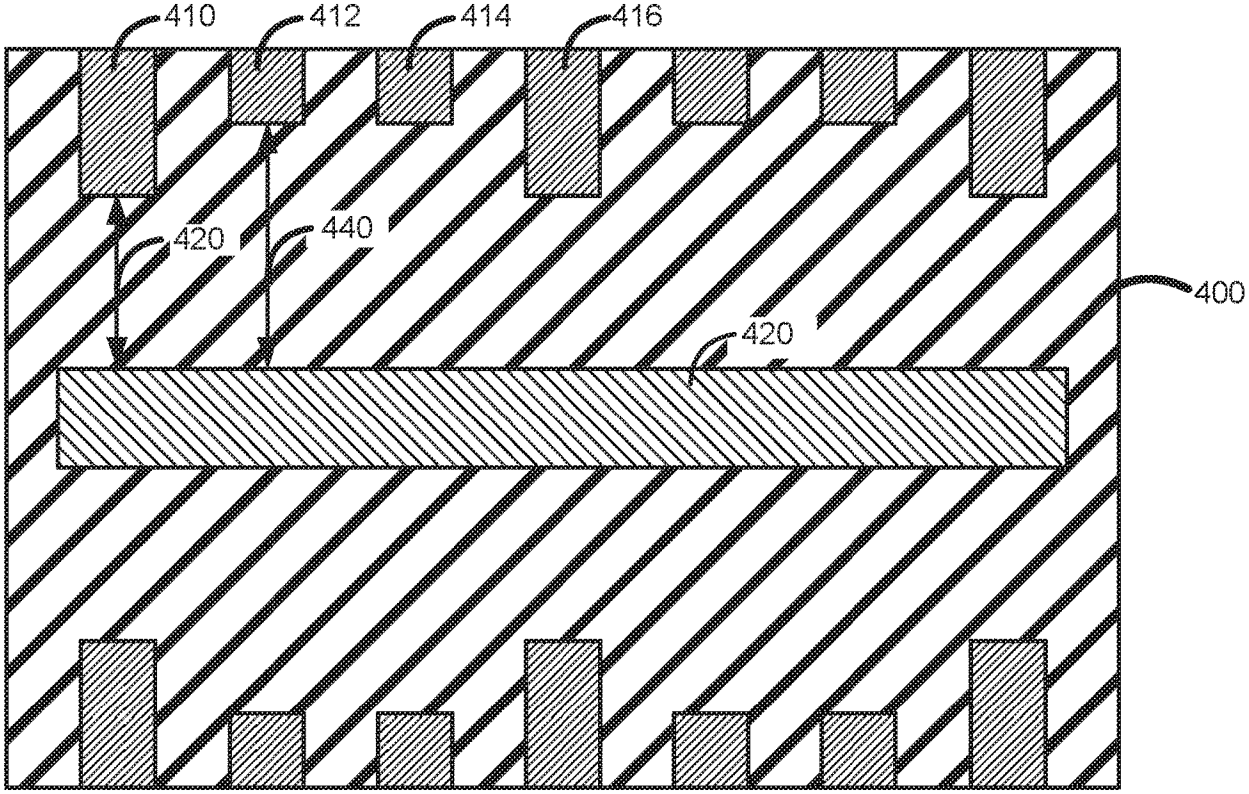
FIG. 4 illustrates a front cross-section view of a connector receptacle tongue according to an embodiment of the present invention.

FIG. 4 illustrates a front cross-section view of a connector receptacle tongue according to an embodiment of the present invention. In this example, contacts or traces 410 and 416 on tongue 400 may be used for power, ground, or other low impedance path. Contacts or traces 412 and 414 may be used to convey signals, such as a differential signal. A depth of contacts or traces 412 and 414 may be reduced such that a distance 440 to ground plane 420 may be greater than a distance 450 below power or ground contact 410. This increase in distance may raise the impedance of a signal line at contacts or traces 412 and 414. In FIG. 2, this may be used to increase a characteristic impedance of transmission line 240, while in FIG. 3 this may be used to raise impedance 340. Using this arrangement, these contact impedances may be increased, while power and ground contacts or traces 410 may retain a large cross-section to increase their current carrying capabilities.

Again, in various embodiments of the present invention, tongue 400 may be formed in various ways. For example, tongue 400 may be formed of metallic contacts, traces, and planes in a plastic or other nonconductive housing. In embodiments where the tongue is a printed circuit board, meaningful differences in contact depths may be difficult to achieve and more reliance may be placed on the other reduction and compensation techniques shown below, though the reduction techniques shown in FIGS. 4-9 may be suitable for printed circuit board tongues as well. In the various embodiments of the present invention where the tongue may be formed of a printed circuit board, the printed circuit board may be part of a larger logic or motherboard for an electronic device.

Figure 5:
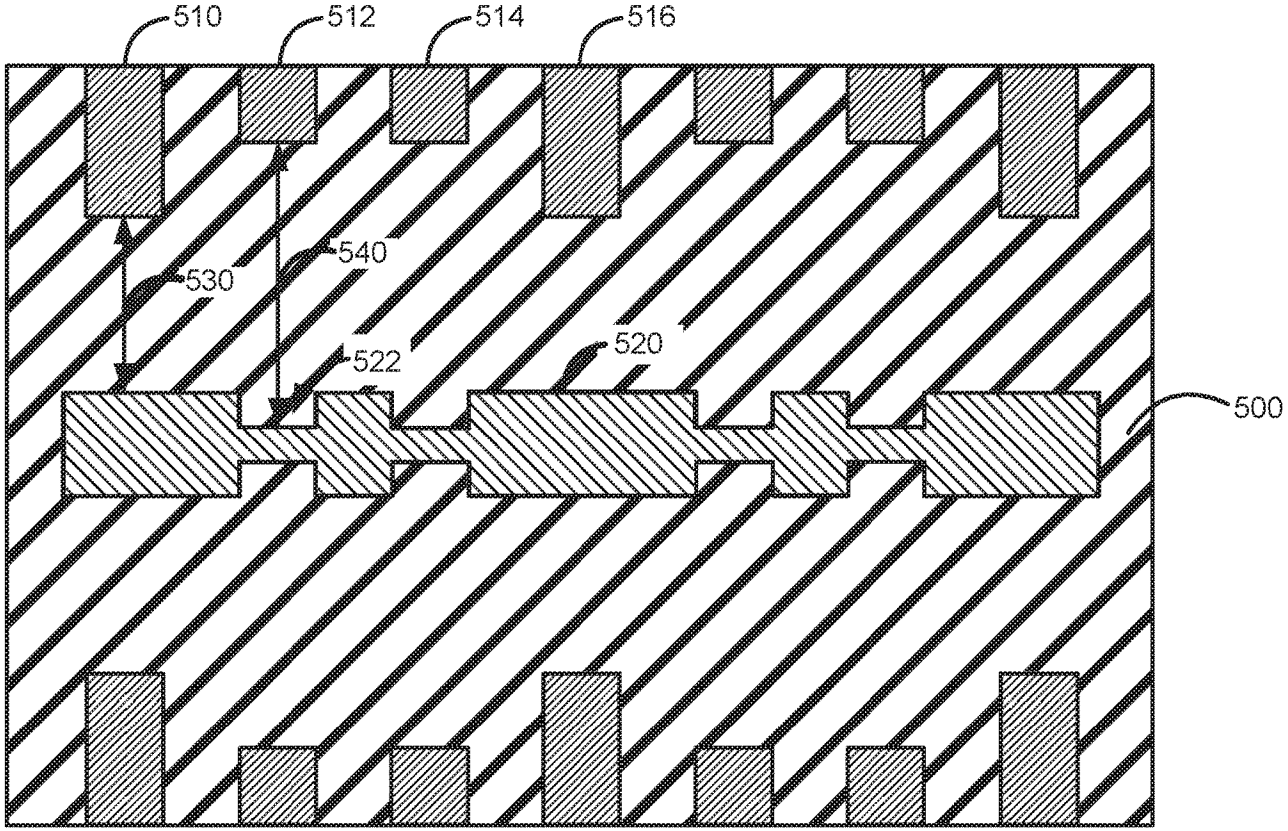
FIG. 5 illustrates another front cross-section view of a connector receptacle tongue according to an embodiment of the present invention.

FIG. 5 illustrates another front cross-section view of a connector receptacle tongue according to an embodiment of the present invention. In this example, ground plane 520 may be notched at points 522 to further increase distance 540 relative to distance 530. As before, contacts or traces 510 and 516 may be used to convey power and ground or other low impedance paths, while contacts or traces 512 and 514 may be used to convey signals, such as a differential signal.

Figure 6:
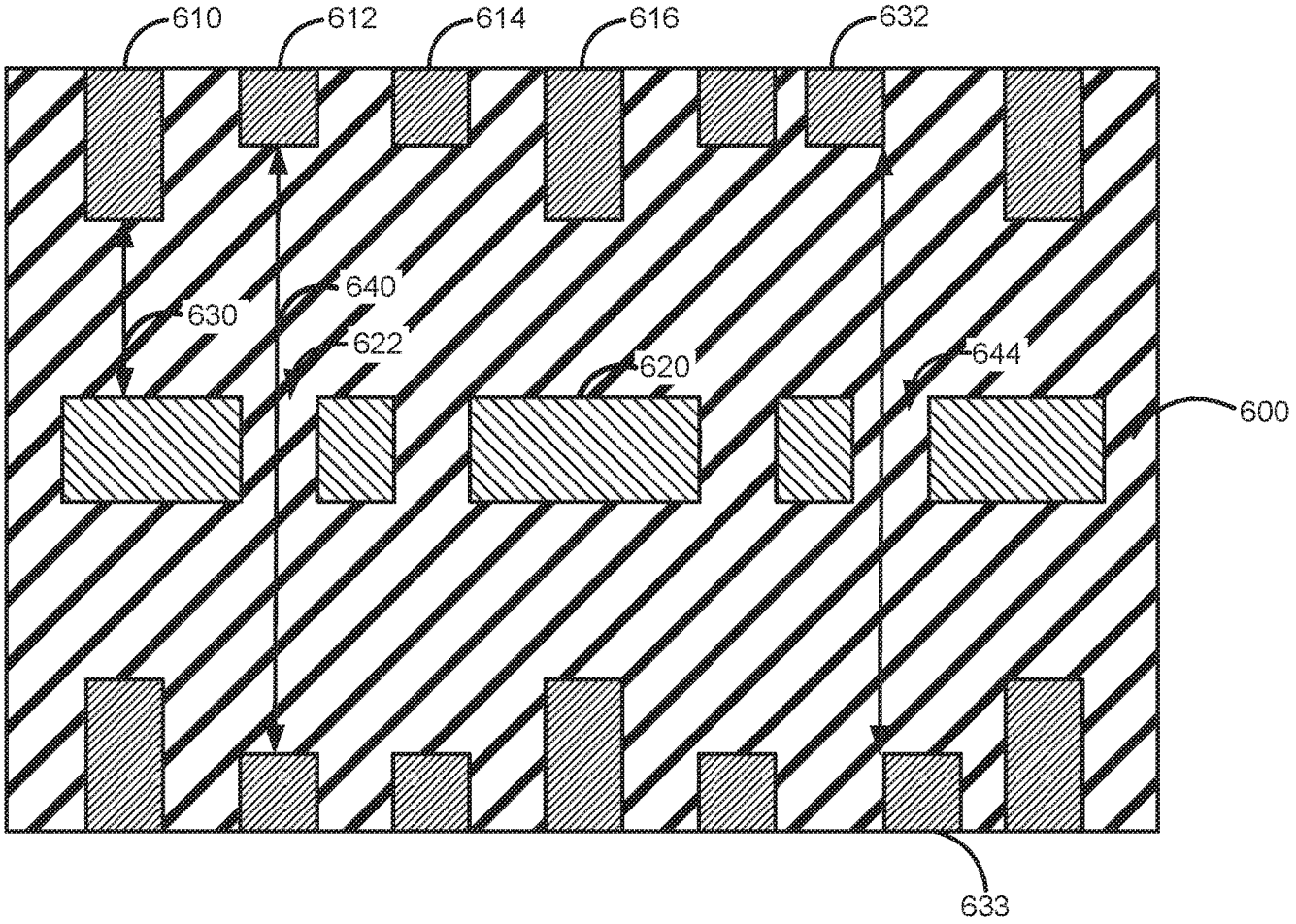
FIG. 6 illustrates another front cross-section view of a connector receptacle tongue according to an embodiment of the present invention.

FIG. 6 illustrates another front cross-section view of a connector receptacle tongue according to an embodiment of the present invention. In this example, holes 622 have been opened in ground plane 620. This may further increase distance 640 relative to distance 630, thereby further reducing impedance loss. Cross talk between signal contacts or traces 612 and 613 on opposite sides of tongue 600 may be possible with this arrangement. However, it may be that an improvement in impedance is enough to warrant use of openings 622 depending on the exact embodiment of the present invention. In various embodiments of the present invention, notches or openings, such as notches 522 and opening 622 may be located at least approximately directly below contacts or traces 612 and the ground planes 520 and 620 may have their full dimensions elsewhere. In other embodiments of the present invention, notches or openings such as these may be joined or continuous for nearby or adjacent contacts.

In these and other embodiments of the present invention, the crosstalk between contacts or traces 612 and 613 may be mitigated by moving one or more contacts or traces laterally such that they do not align with each other. For example, contacts or traces 632 and 633 may be offset from each other such that they do not align with each other through opening 644.

Again, other embodiments of the present invention may employ more than one central power or ground plane. The above techniques may be used in these situations as well. Examples are shown in the following figures.

Figure 7:
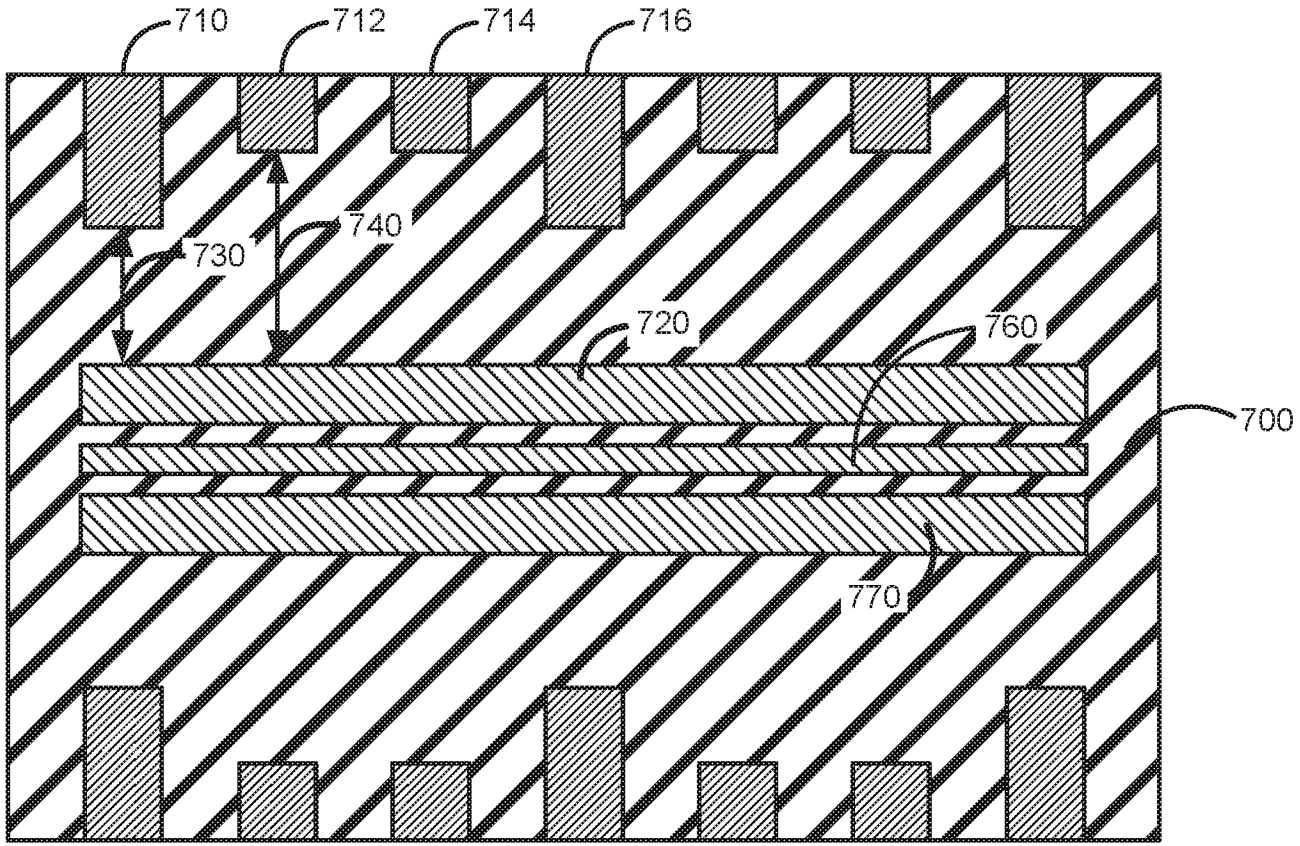
FIG. 7 illustrates another front cross-section view of a computer receptacle tongue according to an embodiment of the present invention.

FIG. 7 illustrates another front cross-section view of a computer receptacle tongue according to an embodiment of the present invention. In this example, tongue 700 may include power plane 760 having ground planes 720 and 770 on each side. In this example, a depth of signal contacts or traces 712 and 714 are reduced as compared to power and ground contacts or traces 710 and 716 such that distance 740 is greater than distance 730.

Again, a high capacitance dielectric may be placed between the power 760 and ground planes 720 and 770 in order to form bypass capacitors between power and ground. This capacitance may help to reduce the return path impedance and may help to reduce power supply noise. For example, a dielectric having a dielectric constant or relative permittivity on the order of 100 to 1,000 or higher may be used. For example, a high capacitance dielectric having a relative permittivity greater than 500 may be used.

Figure 8:
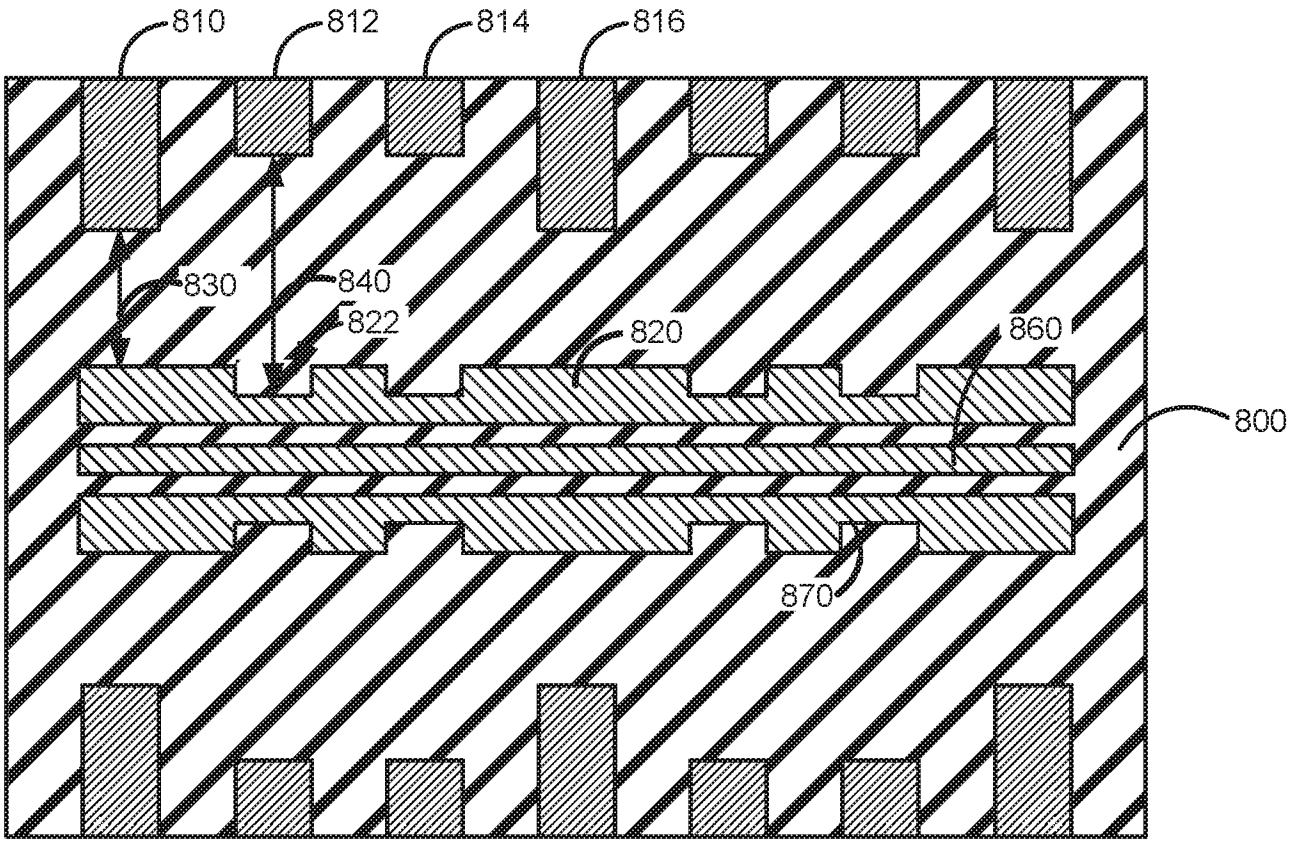
FIG. 8 illustrates another front view cross-section of a computer receptacle tongue according to an embodiment of the present invention.

FIG. 8 illustrates another front view cross-section of a computer receptacle tongue according to an embodiment of the present invention. In this example, notches 822 may be formed to further increase distance 840.

Figure 9:
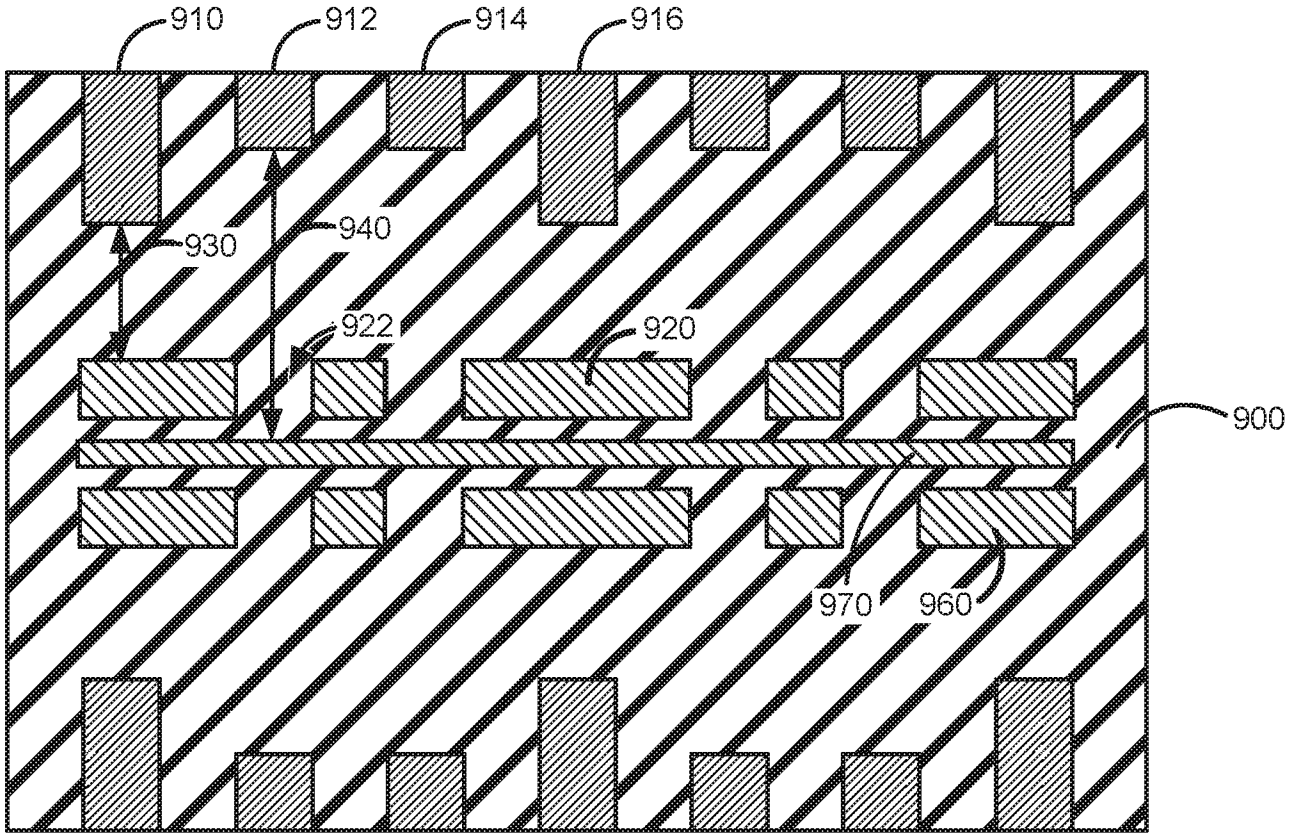
FIG. 9 illustrates another front view cross-section of a computer receptacle tongue according to an embodiment of the present invention.

FIG. 9 illustrates another front view cross-section of a computer receptacle tongue according to an embodiment of the present invention. In this example, openings 922 may be formed in ground planes 920 and 970 to further increase distance 940 as compared to distance 930. In other embodiments of the present invention, power plane 960 may have an opening as well. Again, this may result in cross talk, though improvement in impedance matching may make it worthwhile to accept this downside.

The above techniques may be used to reduce impedance losses near contacts on a connector receptacle tongue. Again, the embodiments shown in FIGS. 4-9 are particularly well-suited for use with tongues having metallic or conductive contacts, traces, and planes that are supported by tongue housings formed of plastic or other nonconductive materials, though they may be used with embodiments that employ tongues formed of printed circuit boards as well. Other embodiments of the present invention may help to prevent impedance gains that may occur at openings between a connector insert and the connector receptacle ground planes. These embodiments of the present invention may be well-suited for use with both plastic tongues and tongues formed using printed circuit boards, which again may be part of a larger logic board, motherboard, or other board in an electronic device. An example is shown in the following figure.

Figure 10:
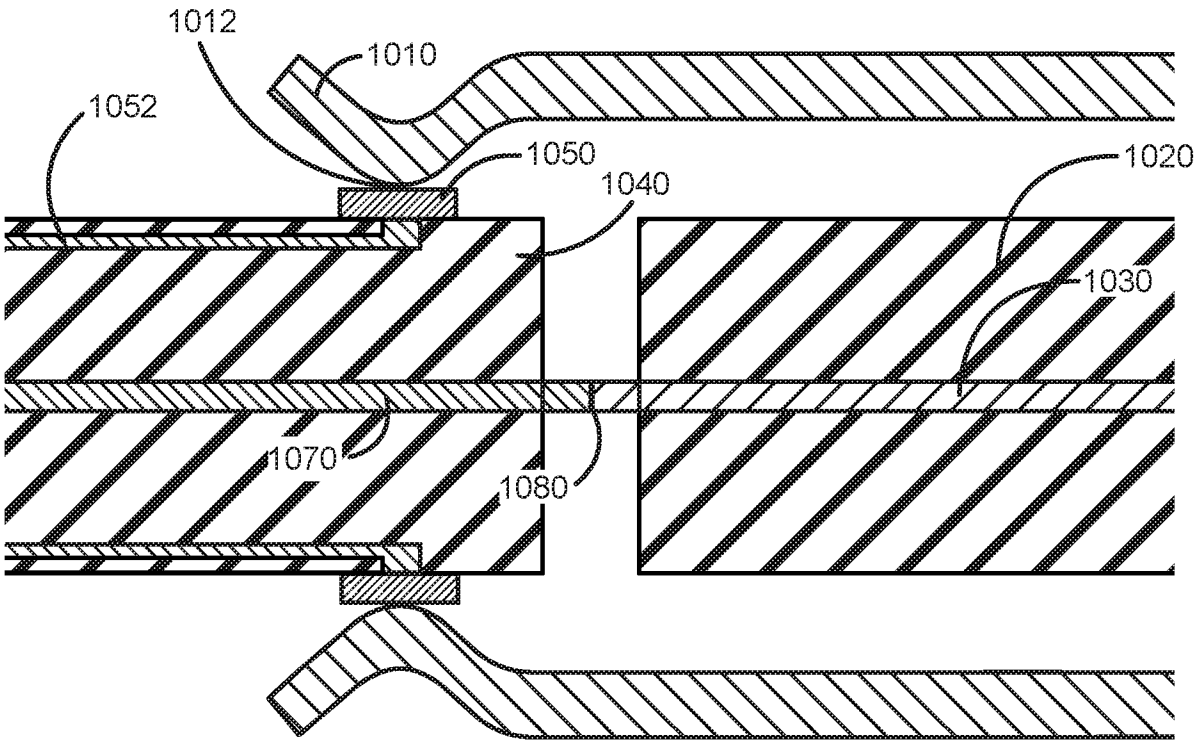
FIG. 10 illustrates another connector system according to an embodiment of the present invention.

FIG. 10 illustrates another connector system according to an embodiment of the present invention. As before, connector insert contacts 1010 may engage contacts 1050 on connector receptacle tongue 1040. Traces 1052 may electrically connect to contacts 1050. In this example, connector insert ground plane 1030 and connector tongue ground plane 1070 may be extended such that they meet at connection point 1080. This may prevent an increase in impedance in the signal path of this point. In FIG. 2, this may correspond to maintaining reducing the impedance of transmission line 220, and in FIG. 3, it may result in maintaining or reducing the impedance 320.

Again, the above embodiments of the present invention may reduce impedance errors in a signal path in a connector system. In these and other embodiments of the present invention, other impedance errors may be introduced in order to compensate for the above, and other, impedance errors. In this way, the average or effective impedance for a signal path may be close to a desired level. An example is shown in the following figure.

Figure 11:
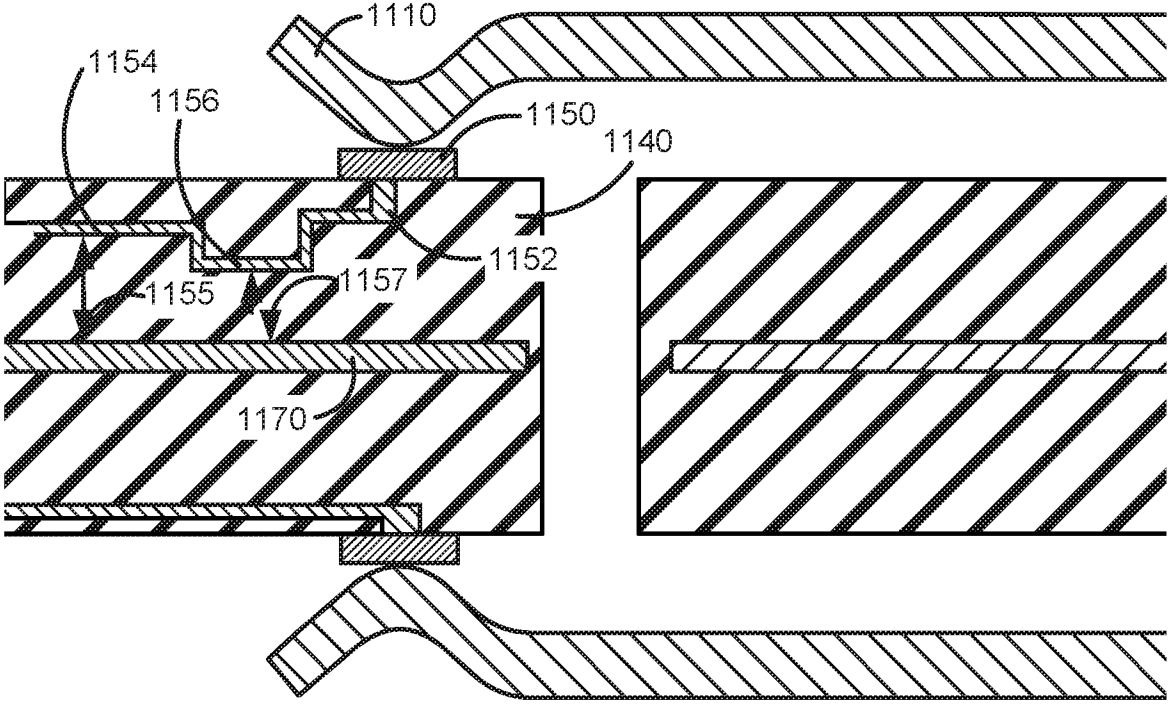
FIG. 11 illustrates another connector system according to an embodiment of the present invention.

FIG. 11 illustrates another connector system according to an embodiment of the present invention. As before, connector insert contacts 1110 may engage contacts 1150 on connector receptacle tongue 1140. Traces 1152 may electrically connect to contacts 1150. Traces 1152 may have various sections or portions, shown here as sections 1154 and 1156. The height over ground plane 1170 may vary among sections. For example, section 1154 may be spaced from ground plane 1170 by distance 1155, while section 1156 may be spaced from ground plane 1170 by distance 1157. Since distance 1157 is shorter than distance 1155, section 1156 may have a lower impedance than section 1154. These techniques may be well-suited for use in embodiments of the present invention that employ tongues formed of printed circuit boards, plastic housings, or other types of tongues.

This variation in impedance may be used to adjust the average or effective value of a signal path to be close to a desired value. In making this adjustment, it should be noted that signals propagating through the above signals paths may pass through the various high-impedance and low-impedance sections or zones in a short amount of time. That is, each of the various high-impedance and low-impedance sections may have a short delay associated with them. These delays may be shorter than the rise and fall times of the propagating signals. The result is that the variation in impedance may be reduced when compared to what may be calculated. That is, the effective impedance for each section may be closer to the desired impedance value. The effective impedance of each section, and the effective impedance of the signal path, may be determined using conventional methods, such as transmission-line theory.

For example, in FIG. 3, the impedances 320 and 340 may be determined. Again, for illustrative purposes, the impedance 320 is shown as 95 ohms, which is 10 ohms higher than the desired value, while the impedance 340 is shown as 75 ohms, which is 10 ohms less than the desired value of 85 ohms. However, since the delays through transmission line sections 220 (which corresponds to impedance 320) and 240 (which corresponds to impedance 340) may be short when compared to the rise and fall times of a signal propagating through them, the effective impedances of transmission lines 220 and 240 may be closer to 85 ohms than these calculated values. Again, these effective impedances, and the effective impedance of the signal path, may be determined using conventional methods, such as transmission-line theory.

In various embodiments of the present invention, the spacing, sizes, and arrangements of transmission line segments in a tongue may be varied to create a filter. Such a filter may remove common-mode energy from differential signal pairs and other types of signals. For example, a choke, notch, low-pass, high-pass, band-pass, or other type filter may be formed. These and similar techniques may be used to filter power supplies as well, for example by forming a common-mode low-pass or "choke" filter. An example is shown in the following figures.

Figure 12B:
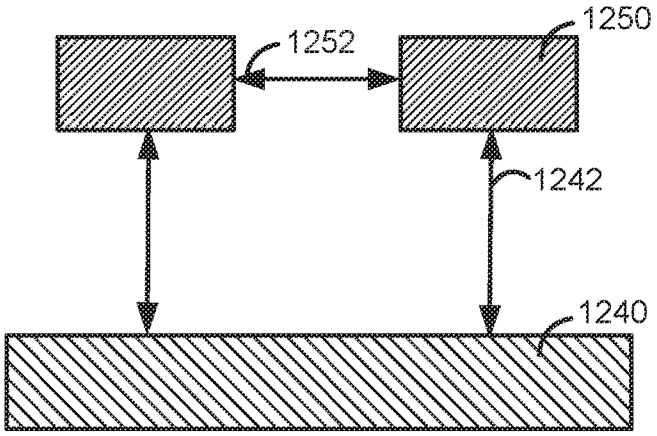
FIG. 12B illustrates a differential signal path having a high common-mode impedance according to an embodiment of the present invention.
Figure 12C:
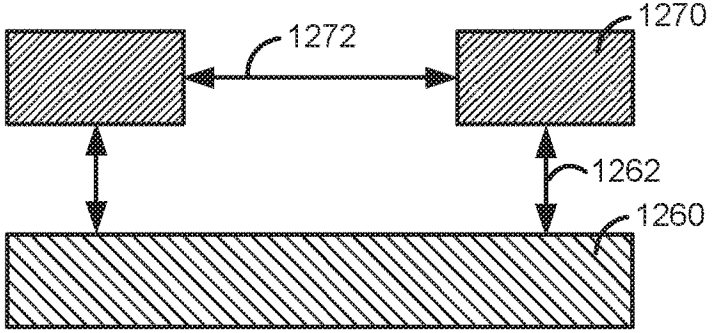
FIG. 12C illustrates a differential signal path having a low common-mode impedance according to an embodiment of the present invention.
Figure 12A:
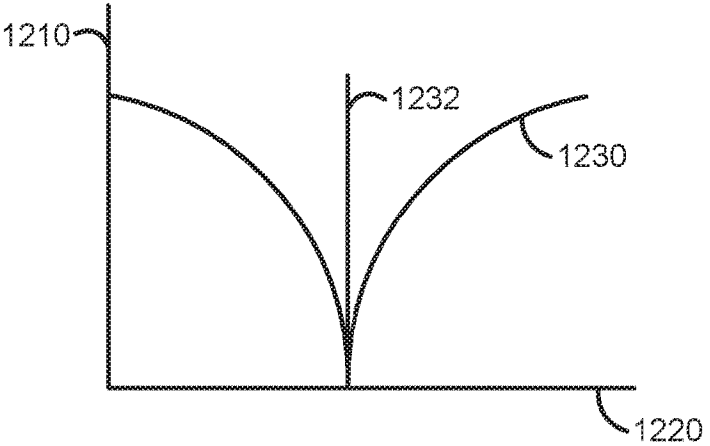
FIG. 12A illustrates a spectrum of a signal passing through signal path according to an embodiment of the present invention.

FIG. 12A illustrates a spectrum of a signal passing through signal path according to an embodiment of the present invention. A signal path may have a spectrum 1230 that may be plotted as an amplitude 1210 over frequency 1220. The spectrum may have a null or low value near a Nyquist frequency. Variations in rise and fall times caused by the above impedance mismatches may create a spike 1232 near the Nyquist frequency. Common-mode and differential-mode impedances of signal paths through the tongue may be varied to form a common-mode filter to reduce the amplitude of spike 1232.

FIG. 12B illustrates a differential signal path having a high common-mode impedance according to an embodiment of the present invention. In this example, signal paths 1250 may be spaced away from ground plane 1240 by a distance 1242 and away from each other by distance 1252. When distance 1242 is relatively high, the impedance between contacts 1250 and ground plane 1240 may be high. The resulting common-mode impedance may be approximately half of the impedance between each contacts 150 and ground plane 1240. This transmission line portion may be combined with other transmission line portions, such as the one shown in the following figure, to achieve signal filtering.

FIG. 12C illustrates a differential signal path having a low common-mode impedance according to an embodiment of the present invention. In this example, signal paths 1270 are spaced from each other by distance 1272 and are a distance 1262 above ground plane 1260. In this example, the impedance between each signal path 1270 and ground plane 1260 may be low, resulting in the low common-mode impedance.

In various embodiments of the present invention, filters may be formed of these trace sections by varying distances 1252, 1272, 1242, and 1262, both in absolute terms and relative to each other. Similarly the thickness and width of traces 1250 and 1270, in absolute terms and relative to each other, may be varied. The material between and among these structures may be varied to change the dielectric constant or permittivity These techniques may be well-suited for use in connector systems that employ tongues formed using printed circuit boards, tongues using metallic contacts, traces, and planes supported by a plastic or nonconductive housing, or other types of tongues.

Again, various techniques may be used by embodiments of the present invention to increase or otherwise vary a signal path's impedance to ground. Also, common-mode and differential-mode impedances may be varied among different sections of traces or interconnect in a connector. These impedances may be arranged to form distributed element filters along these traces. Examples are shown in the following figures.

Figure 13:
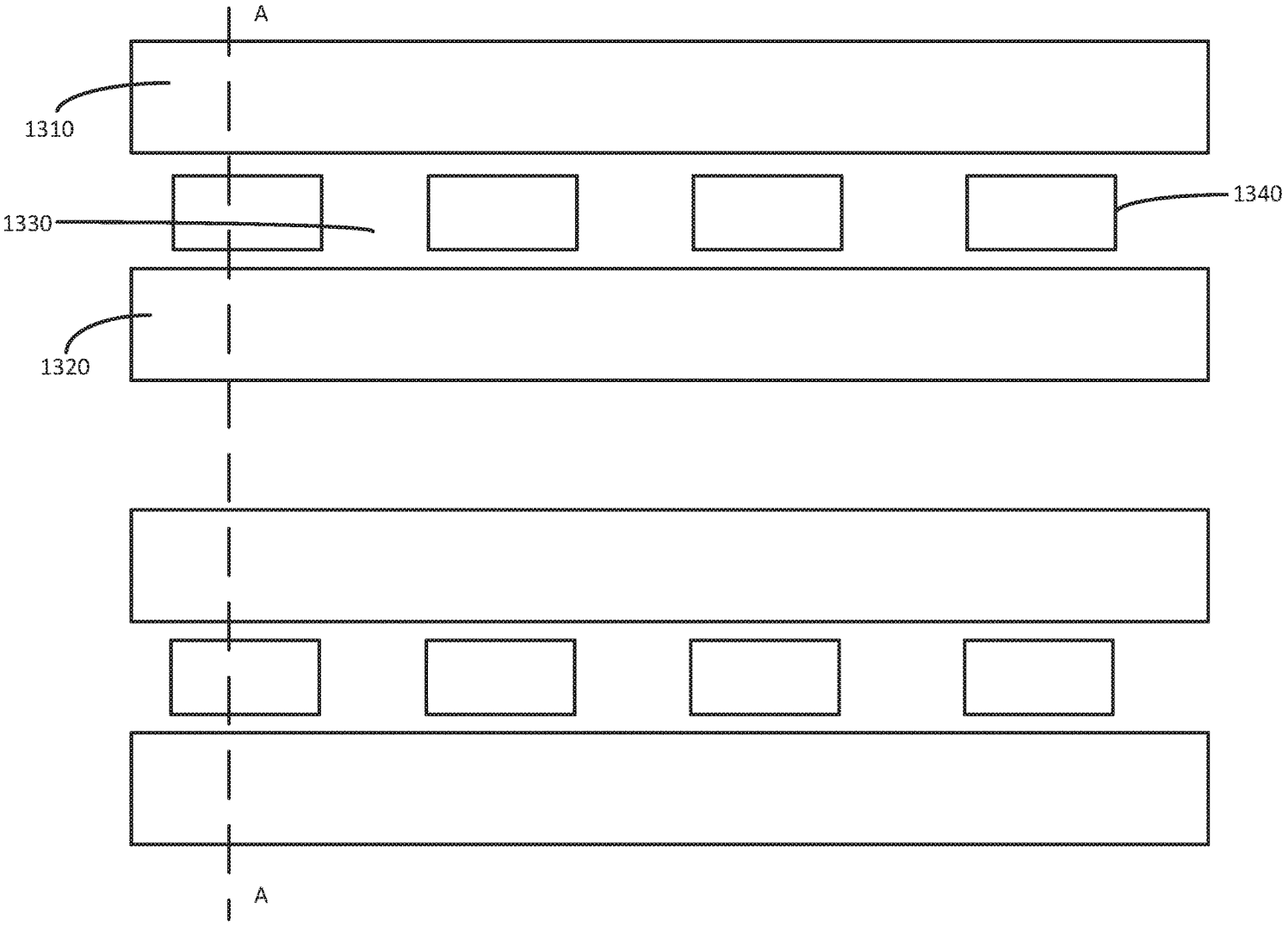
FIG. 13 illustrates a portion of a top surface of a connector tongue according to an embodiment of the present invention.

FIG. 13 illustrates a portion of a top surface of a connector tongue according to an embodiment of the present invention. In this example, two traces 1310 and 1320 may be formed on a surface of a tongue, where the tongue is formed of a material 1330. Material 1330 may be plastic or other material. Material 1330 may be removed in one or more sections 1340 from between traces 1310 and 1320. This removal may decrease a dielectric constant or permittivity between traces 1310 and 1320 near sections 1340. This decrease in the dielectric constant or permittivity may reduce coupling capacitance, thereby increasing the impedance between signal lines or traces 1300 and 1320.

In various embodiments of the present invention, sections 1340 may be formed in various ways. For example, sections 1340 may be formed by etching, molding, micro-machining, drilling, routing, cavitation, laser etching or ablation, or by using other manufacturing techniques.

Figure 14:
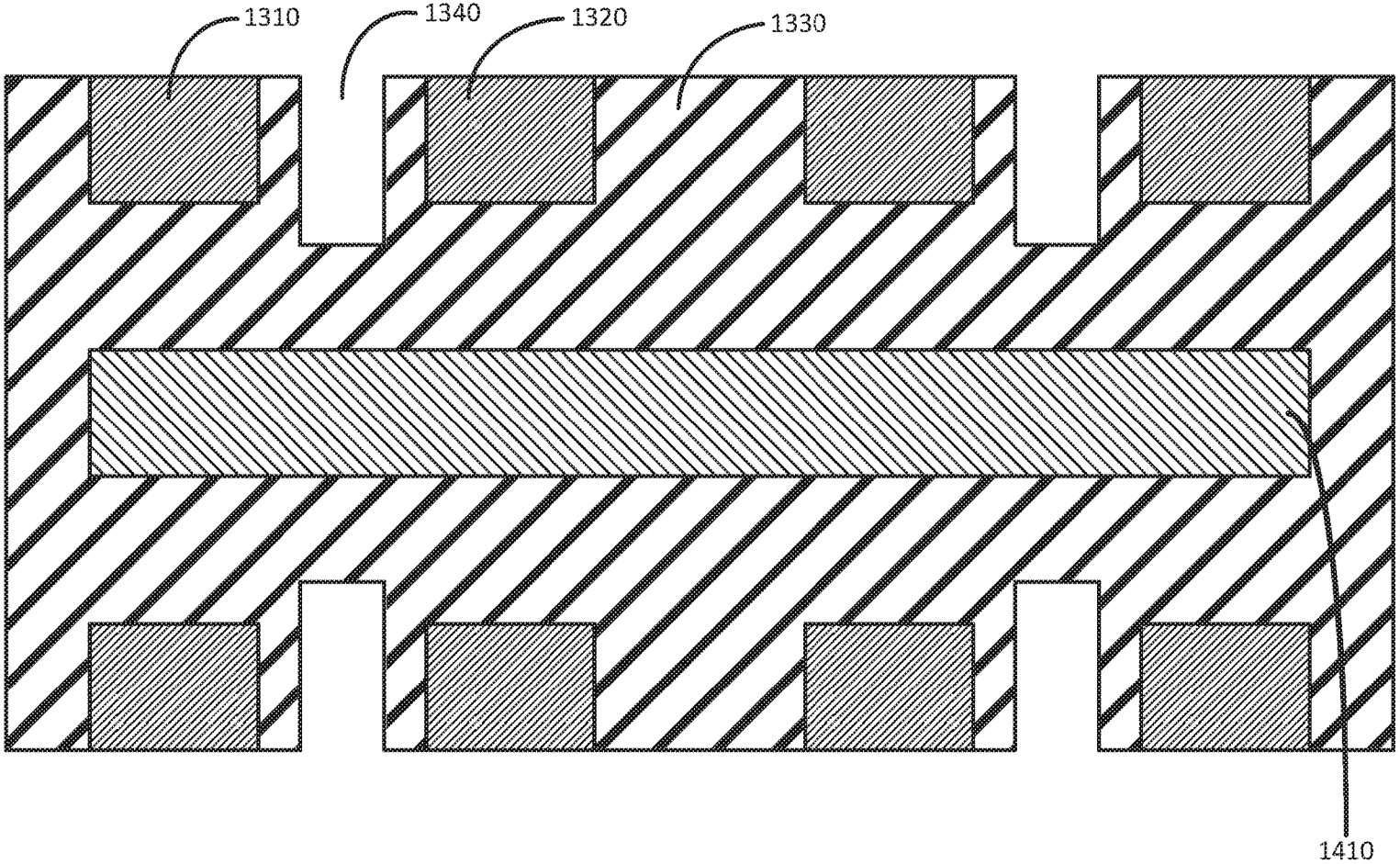
FIG. 14 illustrates a cutaway view of the tongue section of FIG. 13.

FIG. 14 illustrates a cutaway view of the tongue section of FIG. 13. This section view may be taken along cutline A-A in FIG. 13. Again, traces 1310 and 1320 may be formed in a tongue made of a material 1330. Section 1340 may be formed between traces 1310 and 1320. A center ground plane 1410 may also be included.

In this example, sections 1340 may form filter sections along traces 1310 and 1320. For example, a differential impedance between traces 1310 and 1320 may vary along their length to due to these presence of sections 1340. This may form a differential filter. In various embodiments of the present invention, these sections are short enough such that a signal may not react to their presence and may not be filtered.

In various embodiments of the present invention, impedances at a contact on a tongue may be varied. Examples are shown in the following figures.

Figure 15:
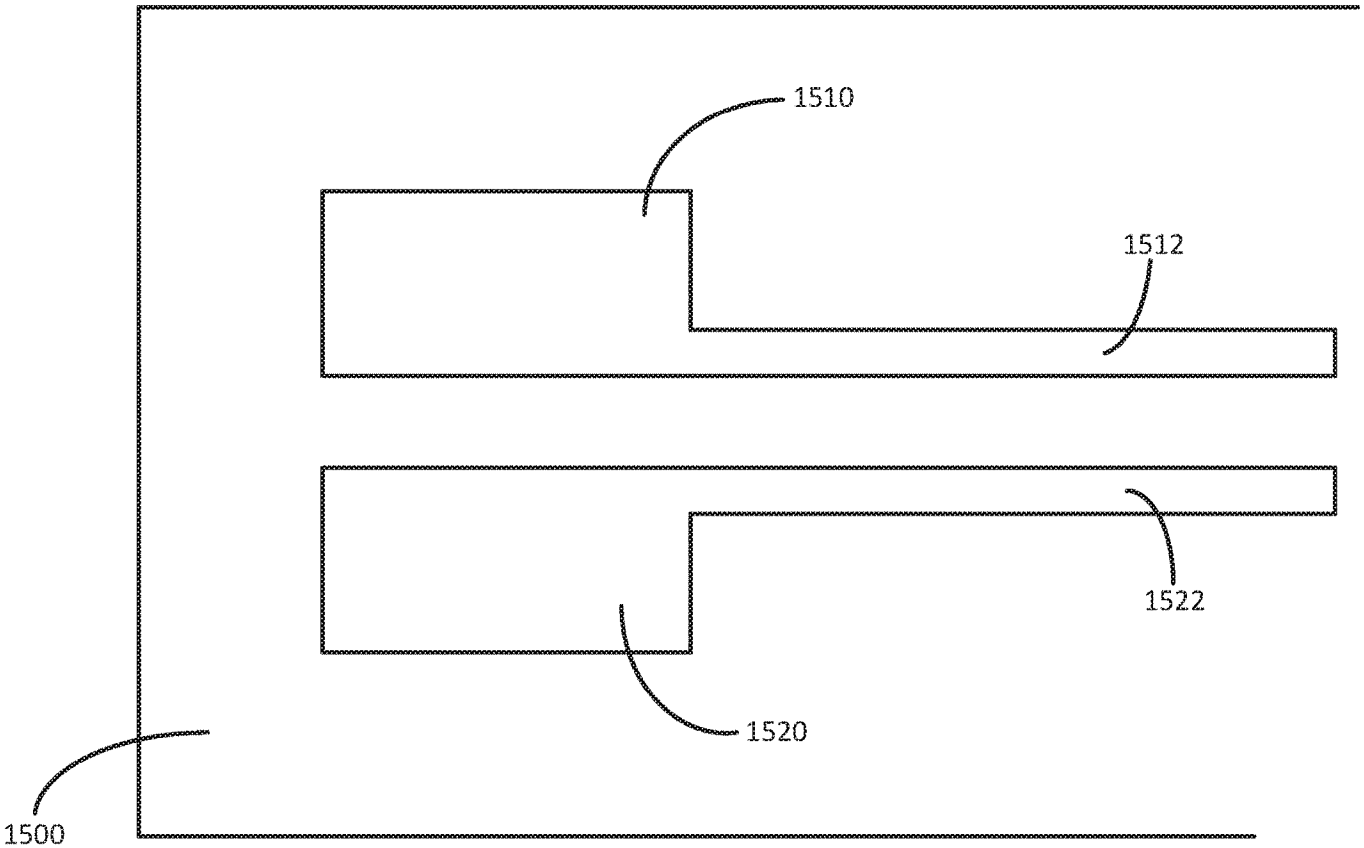
FIG. 15 illustrates a top of a connector tongue according to an embodiment of the present invention.

FIG. 15 illustrates a top of a connector tongue according to an embodiment of the present invention. In this example, tongue 1500 may include two contacts, contacts 1510 and 1520. Contacts 1510 and 1520 may form areas to be contacted by pins or contacts of a corresponding connector. Contacts 1510 and 1520 may be connected to circuitry or components through traces 1512 and 1522.

In various embodiments of the present invention, it may be desirable to either increase or decrease an impedance at contacts 1510 and 1520. It may also be desirable that these contacts form a portion of a common-mode filter. By blocking common-mode currents at these contacts, return currents may not be routed through a shield of this connector. By preventing currents from being routed on the shield, the currents do not generate a voltage at the resistance of the shield. In this way, electromagnetic interference that would otherwise be generated by the connector may be reduced.

Figure 16:
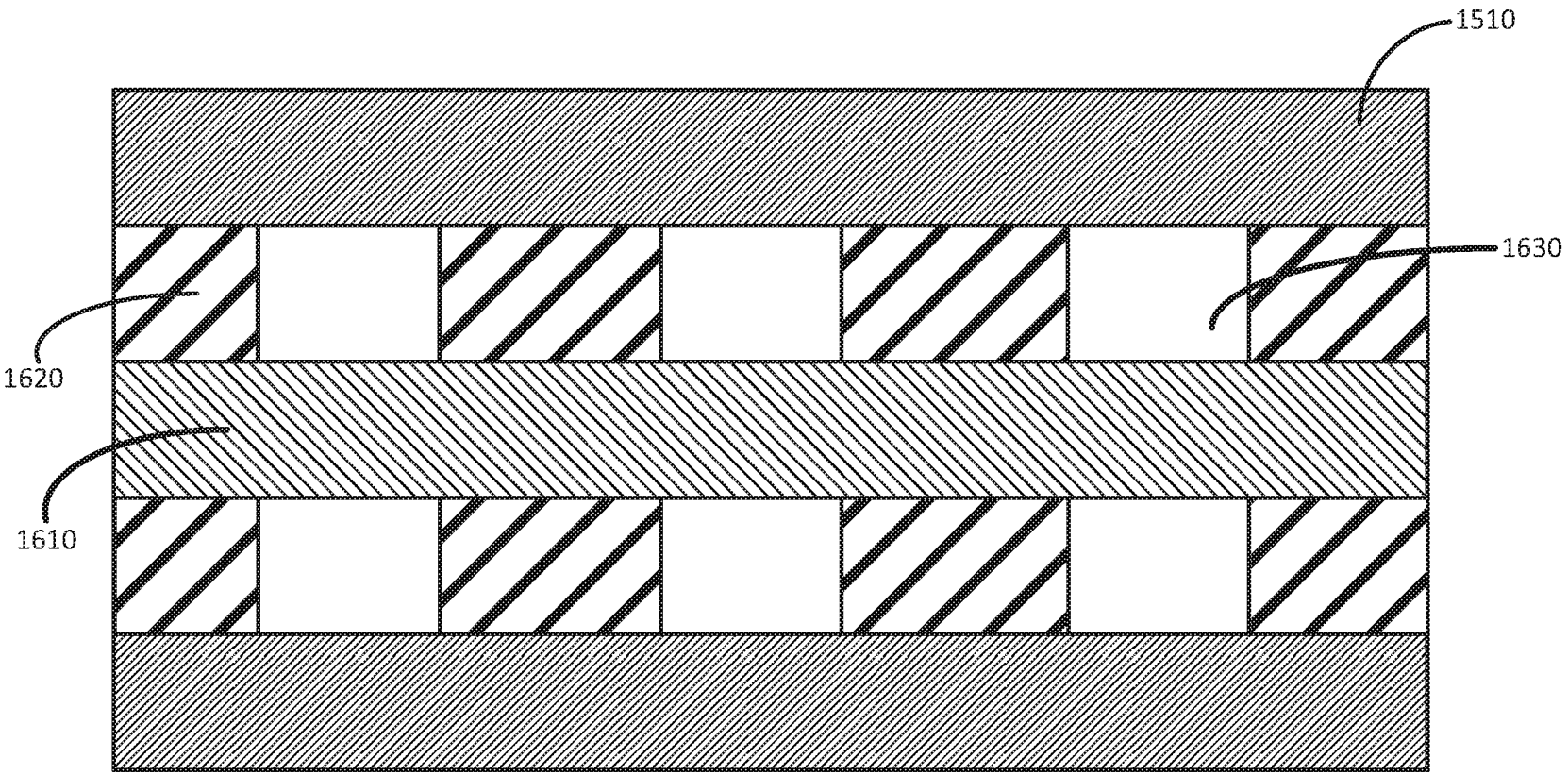
FIG. 16 illustrates a cross section of a connector tongue according to an embodiment of the present invention.

FIG. 16 illustrates a cross section of a connector tongue according to an embodiment of the present invention. In this example, contacts 1510 may be separated from center ground plane 1610 by material 1620. One or more openings 1630 may be formed in material 1620. These openings may have a lower dielectric constant, thereby decreasing a capacitance between contacts 1510 and ground plane 1610. This may result in a higher impedance for contact 1510.

In this and other examples shown, instead of simply removing material to form sections such as 1340 and 1630, other material having different dielectric constant may be used to form these sections. As before, sections 1630 may be formed by etching, molding, micro-machining, drilling, or by using other manufacturing techniques.

Figure 17:
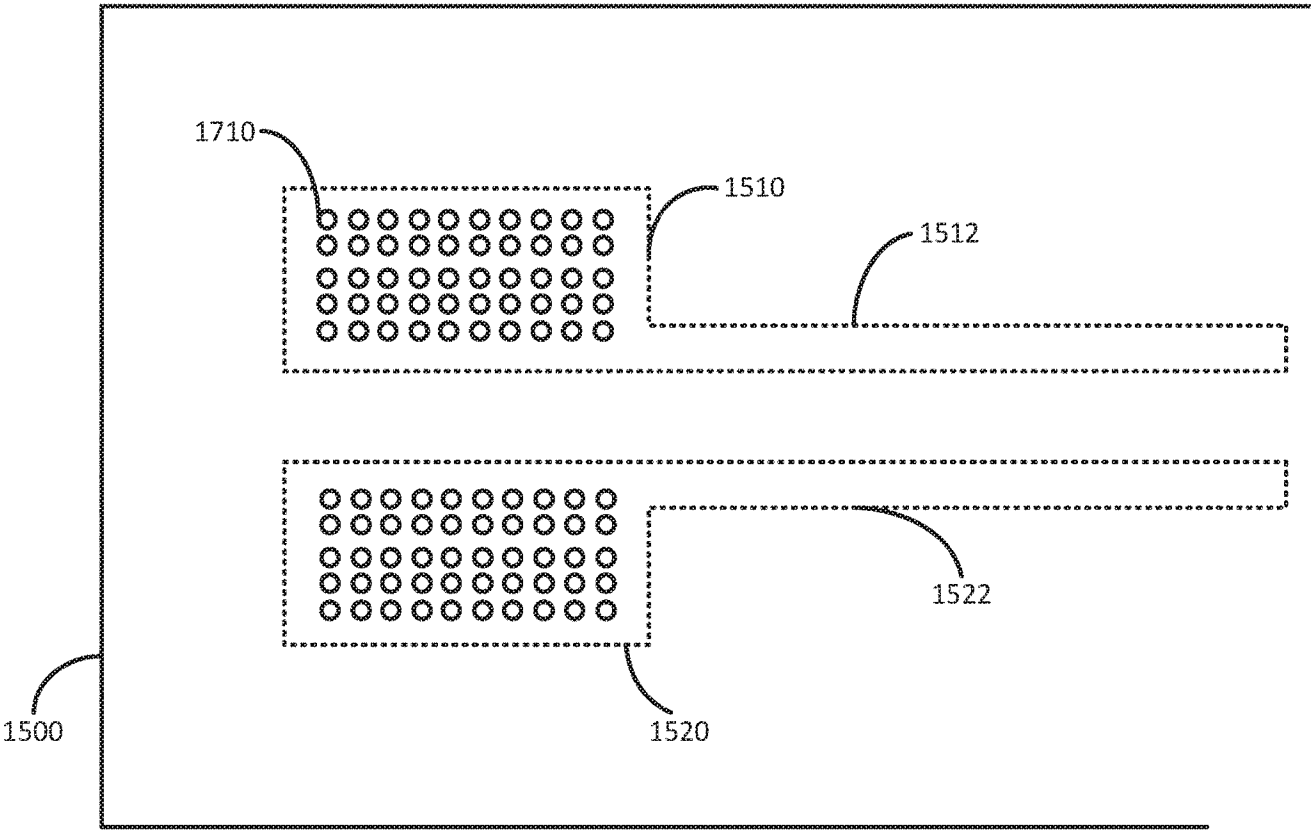
FIG. 17 illustrates a top view of a portion of a connector tongue according to an embodiment of the present invention.

FIG. 17 illustrates a top view of a portion of a connector tongue according to an embodiment of the present invention. Again, tongue portion 1500 may include contacts 1510 and 1520. Either or both the dielectric below contacts 1510 and 1520 or the center ground plane may include a number of perforations or micro-vias 1710. Perforations 1710 may be formed using a drill, etch, micro-machining, or other techniques. These perforations may act to reduce a capacitance and increase an impedance between contacts 1510 and 1520 and ground. In various embodiments of the present invention, the use of perforations 1710 may be limited to avoid weakening the structure of tongue 1500.

Again, in various embodiments of the present invention, it may be desirable to either raise or lower an impedance of a contact or trace. An example is shown in the following figure.

Figure 18:
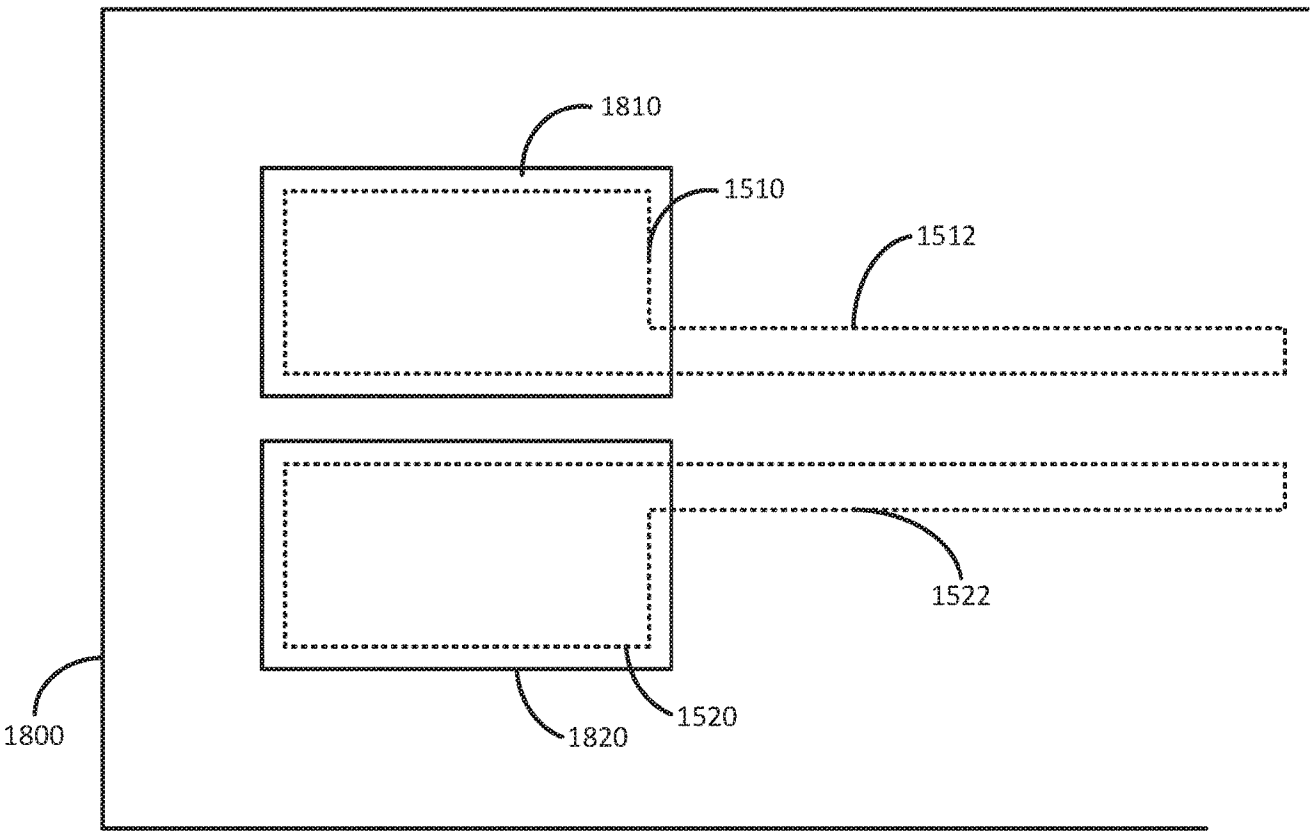
FIG. 18 illustrates a top view of a portion of a connector tongue according to an embodiment of the present invention.

FIG. 18 illustrates a top view of a portion of a connector tongue according to an embodiment of the present invention. Again, contacts 1510 and 1520 may be located over or a tongue including central ground plane 1800. Center ground plane 1800 may include features 1810 and 1820. Features 1810 and 1820 may be a lowered recess, a raised mesa, or other type of feature. A lowered recess may cause a decrease in capacitance and an increase the impedance between contacts 1510 and 1520 and center ground plane 1800. A raised mesa may increase the capacitance and decrease the impedance between contacts 1510 and 1520 and center ground plane 1800.

Figure 19:
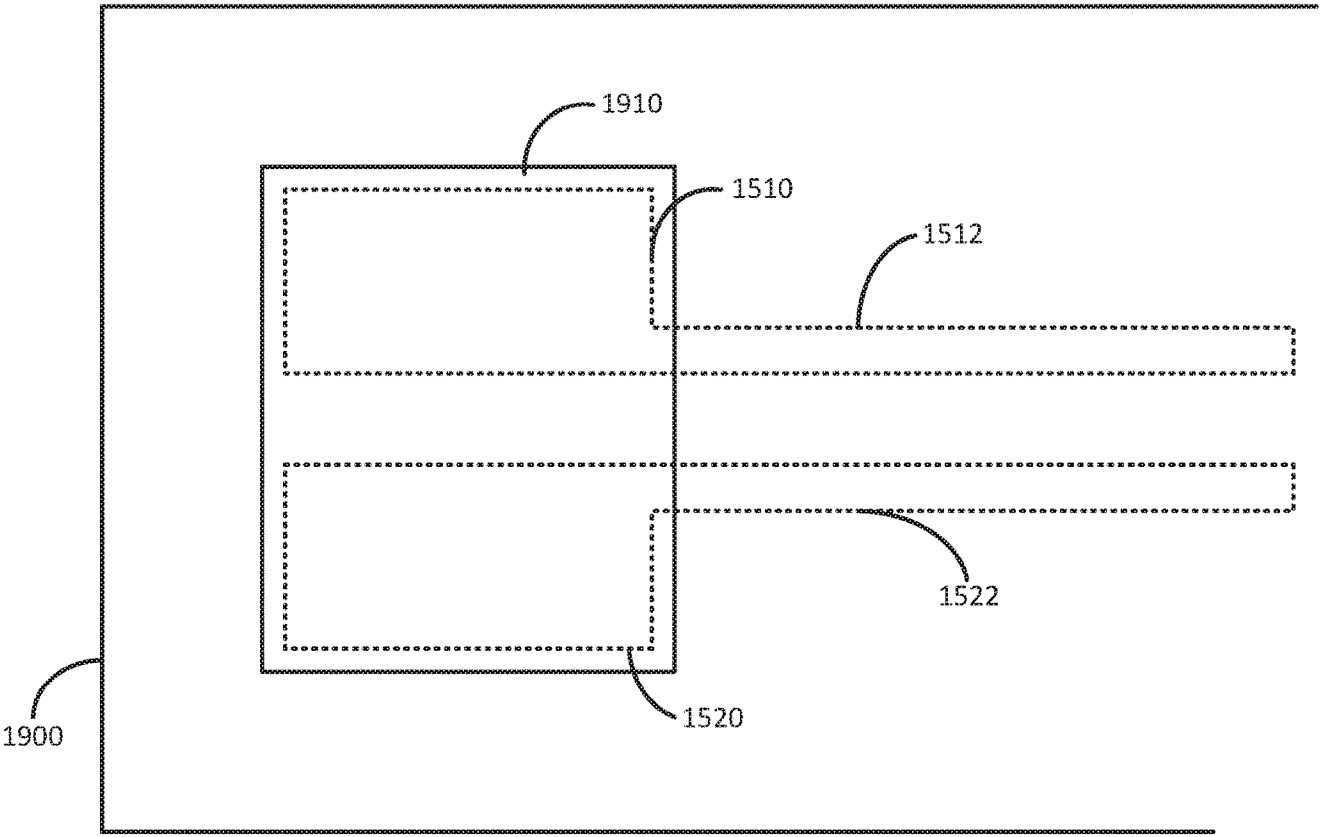
FIG. 19 illustrates a top view of a portion of a tongue according to an embodiment of the present invention.

FIG. 19 illustrates a top view of a portion of a tongue according to an embodiment of the present invention. In this example, features 1810 and 1820 have been merged into a single feature 1910.

Again, common-mode and differential-mode impedances may be varied among different sections of traces or interconnect in a connector. Other structures, such as open ended or shorted stubs may be included. These impedances may be arranged to form distributed element filters along these traces.

In these and other embodiments of the present invention, a differential-mode impedance may be kept constant while the common-mode impedance may be varied along a pair of traces, or a differential trace. These variations in common-mode impedance along a differential trace may be arranged using distributed element filter and transmission filter techniques to form filters to block common-mode signals while allowing differential-mode signals pass.

In general, to vary a common-mode impedance while maintaining a differential-mode impedance between a first section of a differential trace and a second section of a differential trace, two or more parameters, such as spacing, width, thickness, dielectric constant, or other parameter, may be varied between the first and second sections. In one example, a width and a spacing may be varied such that they cancel each other in terms of differential-mode impedance, but cause a variation in common-mode impedance along the trace. An example is shown in the following figure.

Figure 20:
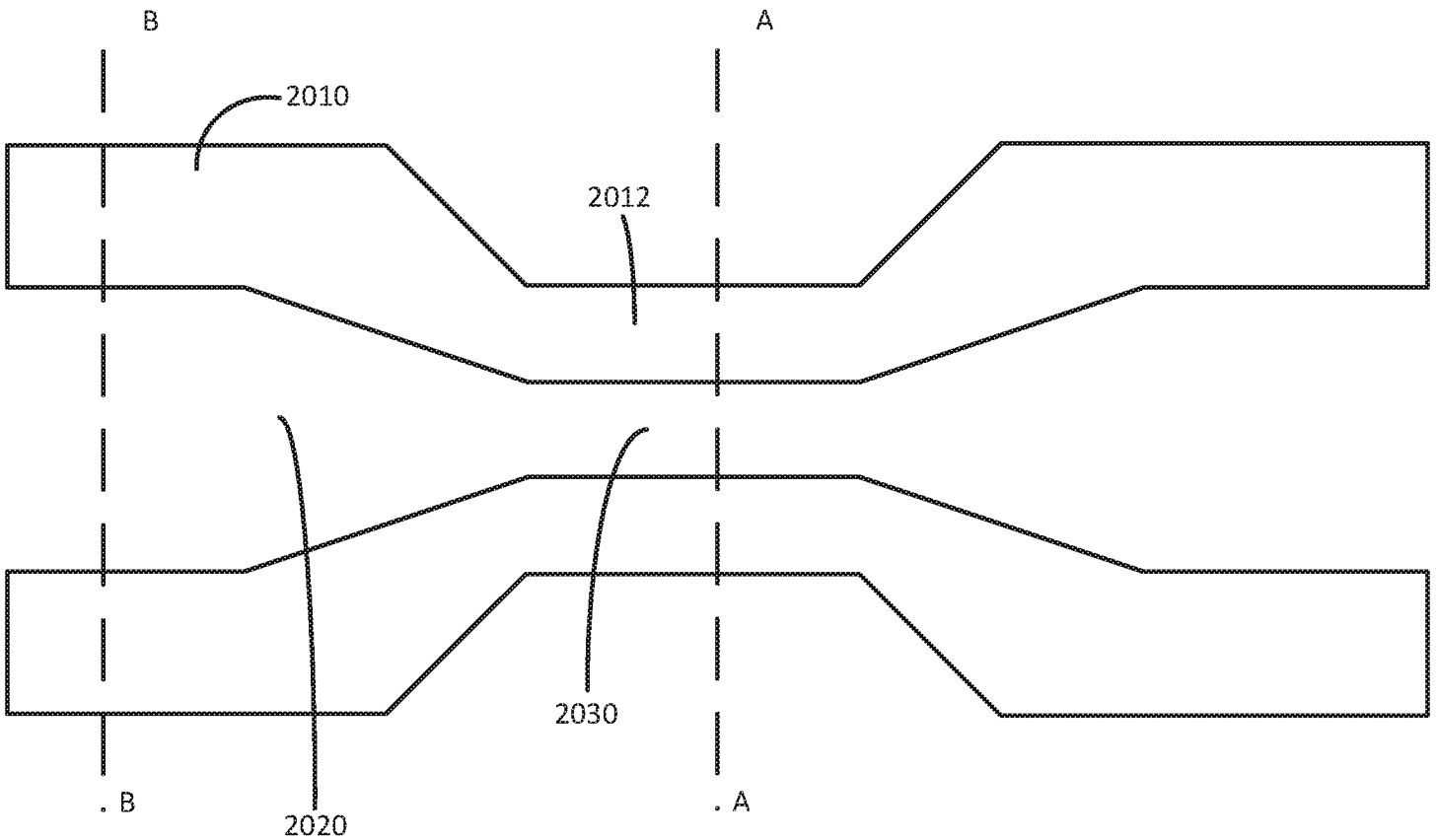
FIG. 20 illustrates a top view of a portion of a connector tongue according to an embodiment of the present invention.

FIG. 20 illustrates a top view of a portion of a connector tongue according to an embodiment of the present invention. In this example, two traces, or a differential trace, in section 2010 may be varied in spacing and width. In this example, along line B-B, the traces in section 2010 may be wider than the traces in section 2012 along line A-A. The traces in section 2010 may be further away from each other along line B-B than the traces in sections 2012 are along line A-A.

A common-mode impedance along trace section 2010 may be higher than a common-mode impedance of the section 2012. This is because the traces are wider in section 2010 than the traces in section 2012. This change in common-mode impedance may be enhanced by changing the materials below the traces in sections 2010 and 2012 such that they have different dielectric constants. The change in common-mode impedance may additionally be enhanced by changing a width of a trace or a center ground plane such that the distance between the two is varied between sections 2010 and 2012. In various embodiments of the present invention, different materials having a different dielectric constant or permittivity may be used for materials 2020 and 2030. This may be used to further change the common-mode impedance between these two sections.

Accordingly, the common-mode impedances between sections 2010 and 2012 may be different. However, the differential-mode impedance between traces in these sections may be a function of the width of traces in a section and a spacing or distance between the traces in a section. Accordingly, the since the traces are narrower but closer together in section 2012 while being wider but further spaced in section 2010, the differential-mode impedances in sections 2010 and 2012 may match.

It should be noted that the term distances as used herein may be an electrical distance and is not limited to a purely physical distance. The electrical distance may be a function of both the physical distance and the dielectric constant or permittivity of any intervening materials. Accordingly, differences in a dielectric constant or permittivity of materials 2020 and 2030 may change the electrical distance even though the physical distance between traces in sections 2010 and 2012 does not change.

In this way, common-mode impedances may be varied along a trace, while a differential-mode impedance may remain relatively constant. These sections may be arranged using distributed element filter and transmission filter techniques to form filters to block common-mode signals while allowing differential-mode signals pass.

In the above example, a width and a spacing may be varied such that they cancel each other in terms of differential-mode impedance, but cause a variation in the common-mode impedance along the differential trace. In other embodiments of the present invention, two parameters may be varied to cancel a variation in one other parameter. For example, a change in dielectric between portions of a differential trace, a change in a width of the trace, and a change in the spacing of the trace, may be varied such that the differential-mode impendence is kept constant while the common-mode impedance is varied. An example is shown in the following figure.

Figure 21:
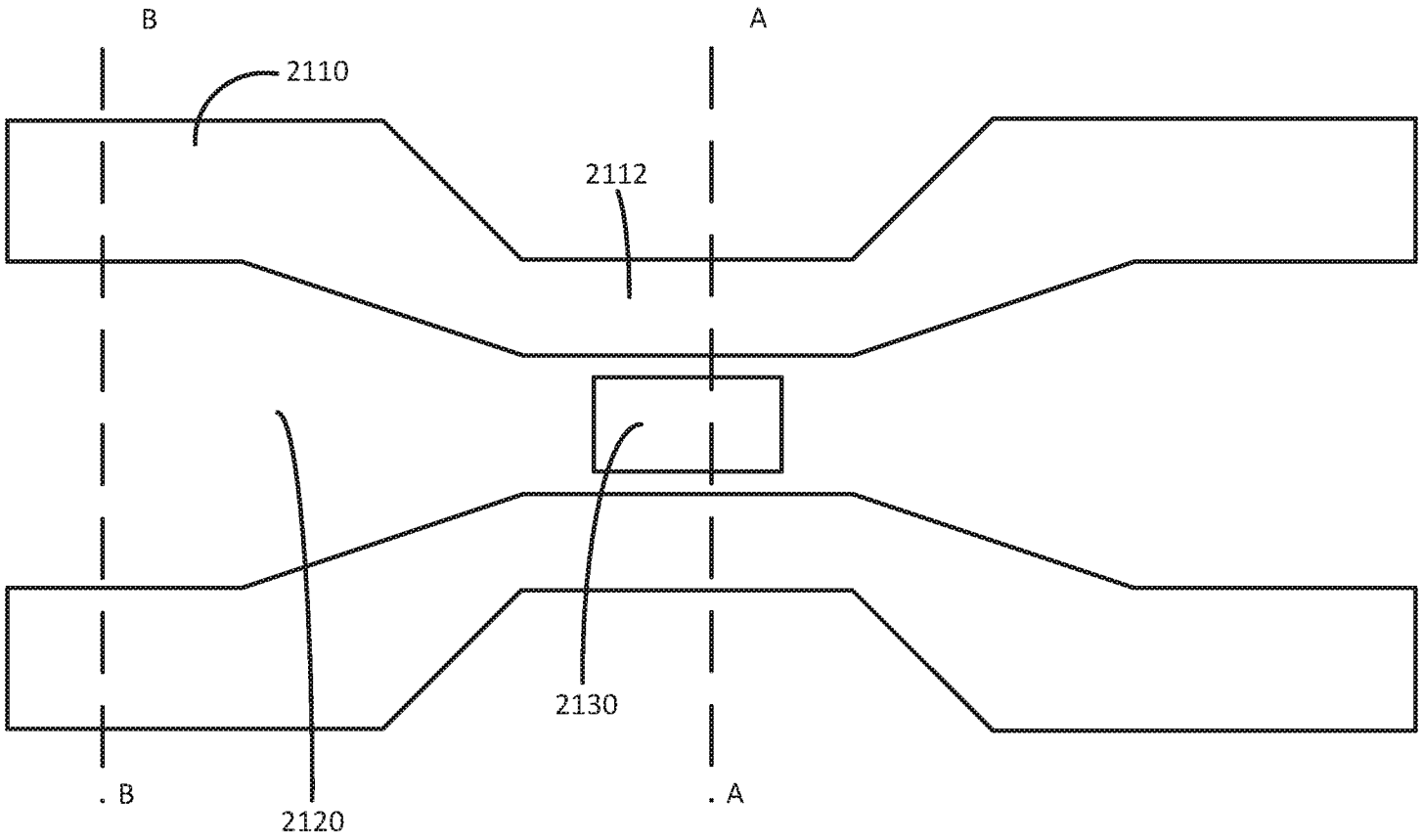
FIG. 21 illustrates another top view of a portion of a connector tongue according to an embodiment of the present invention.

FIG. 21 illustrates a portion of a top surface of a connector tongue according to an embodiment of the present invention. In this example, two traces having sections 2110 and 2112 may be formed on a surface of a tongue, where the tongue is formed of a material 2120. Material 2120 may be plastic, printed circuit board, or other material. Material 2120 may be removed in one or more sections 2130 from between trace sections 2112. This removal may decrease a dielectric constant or permittivity between trace sections 2112. This decrease in the dielectric constant or permittivity may reduce coupling capacitance, thereby increasing the differential-mode impedance between trace sections 2112.

The traces in section 2112 may also be thinner than the traces in section 2110. This may further decrease coupling capacitance between traces in section 2112, thereby further increasing the differential-mode impedance between trace sections 2112.

To compensate for these increases, the traces in section 2112 may be closer than the traces in section 2110. This may increase coupling capacitance between traces in section 2112, thereby further decreasing the differential-mode impedance between trace sections 2112. This decrease may be adjusted to compensate for the increases in differential-mode impedances caused by the traces having an opening between them and from being narrower in section 2112.

While the differential-mode impedance may be constant between sections 2110 and 2112, the common-mode impedance may vary. For example, the wider traces in section 2110 may result in a higher capacitance to a central ground plane, leading to a lower common-mode impedance as compared to the trace sections 2112.

In various embodiments of the present invention, opening sections 2130 may be formed in various ways. For example, opening sections 2130 may be formed by etching, molding, micro-machining, drilling, cavitation, laser etching or ablation, or by using other manufacturing techniques.

In these and other embodiments of the present invention, ground and power supply connections between a connector insert and a connector receptacle may form loops that traverse the interface between the connector insert and the connector receptacle. These loops may include contacts and traces in the connector insert and the connector receptacle. These loops may form stray or parasitic inductances and capacitances. These inductors and capacitors may include tank circuits that may oscillate during device operation. Such oscillations may occur at very high frequencies and may cause cross-talk and electromagnetic interference.

Figure 29:
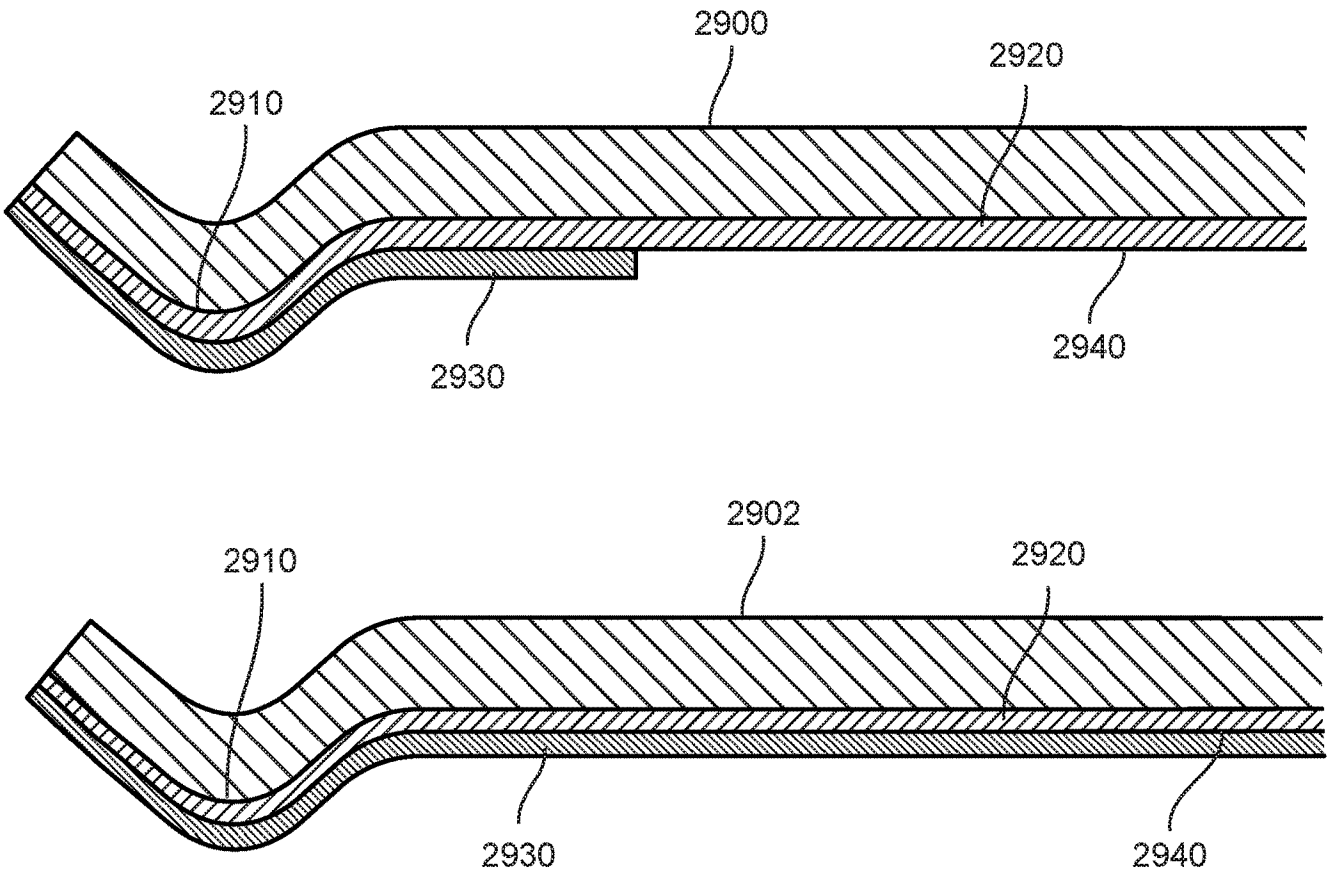
FIG. 29 illustrates a contact according to an embodiment of the present invention.

In these and other embodiments of the present invention, these oscillations may be reduced or otherwise mitigated by inserting series resistances in the loops. These series resistance may be resistances of ground, power, or other contacts in either or both the connector insert or connector receptacle. The resistance of these contacts may be increased in various ways in various embodiments of the present invention. For example, plating layers, such as a gold or other low-resistance layers 2930 may be omitted from all or a portion or first area 2940 of contact 2900, as shown in FIG. 29. In these and other embodiments of the present invention, a contacting surface 2910 of contact 2900 (such as contact 110 in FIG. 1, as shown in FIG. 29, or the other contacts shown here or otherwise consistent with embodiments of the present invention) may be plated with a high permeability material, such as nickel 2920, with a gold plated overlay 2930 to reduce impedance. A remainder or first area 2940 of contact 2900 might not be gold plated, thereby exposing the nickel plating 2920 on those portions. This absence of gold plating 2930 may increase the resistance of a parasitic tank circuit due to the high permeability of nickel. More specifically, the skin depth of high permeability materials such as nickel is very shallow for high frequency signals (for example, 0.05 microns at 10 GHz), and this shallow skin depth may increase the impedance at frequency (for example, 15 ohms series resistance.) This may reduce the quality factor (or Q), which may reduce the peak energy in in any resonance. This may help to reduce cross-talk and electromagnetic interference. In these and other embodiments of the present invention, gold plating 2930 may be absent or omitted from a first area 2940 of signal pin or contact 2900 to increase the series impedance, while gold 2930 may be present in the same first area 2940 in power and ground contacts, such as contact 2902 shown in FIG. 29.

In these and other embodiments of the present invention, one or more higher-resistance layers may be plated over all or a portion of a contact. This higher-resistance layer may similarly help to reduce cross-talk and electromagnetic interference. While nickel 2920 and gold 2930 are shown here in this example, in these and other embodiments of the present invention, other platings with a high permeability that provide the desired series impedance may be used. That is, various materials with a high permeability (ability to conduct magnetic fields), such as nickel, iron, or other material may be used. This material may also have a low resistance or impedance at low frequencies (ability to conduct electricity.) However, due to their high permeability, these materials may have a shallow skin depth, thereby increasing their impedance at frequency. In these and other embodiments of the present invention, a high permeability material may be at least partially overlaid or plated with a low impedance material.

In these and other embodiments of the present invention, a connector may be used to convey multiple data signals. These multiple data signals may be conveyed on signal pins or contacts that are nearby or adjacent to each other in a connector. These signal contacts may be on a same side of a connector opening or tongue or on different sides of a connector opening or tongue. Data signals on these nearby or adjacent pins may generate electromagnetic interference, which may interfere with other signals and degrade the quality of data transmission.

Accordingly, in these and other embodiments of the present invention, a signal strength of a first signal may be reduced to improve a signal-to-noise ratio of a second signal. For example, a first signal may have a relatively large amplitude. The first signal may accordingly have a relatively high signal to noise ratio. A second adjacent or nearby signal may have a smaller amplitude. The first signal with its larger amplitude may interfere with the second signal, thereby degrading the signal to noise ratio of the second signal. Conversely, the second, lower-amplitude signal may not interfere with the first signal to the same degree. Accordingly, the amplitude of the first signal may be reduced to improve system performance. While this amplitude reduction may degrade the signal-to-noise ratio for the first signal, it may provide an improved system performance by increasing the signal-to-noise ratio of the second signal. That is, the first signal having a reduced amplitude may interfere with the second signal to a lesser degree, thereby improving the signal-to-noise ratio of the second signal. An example is shown in the following figure.

Figure 22:
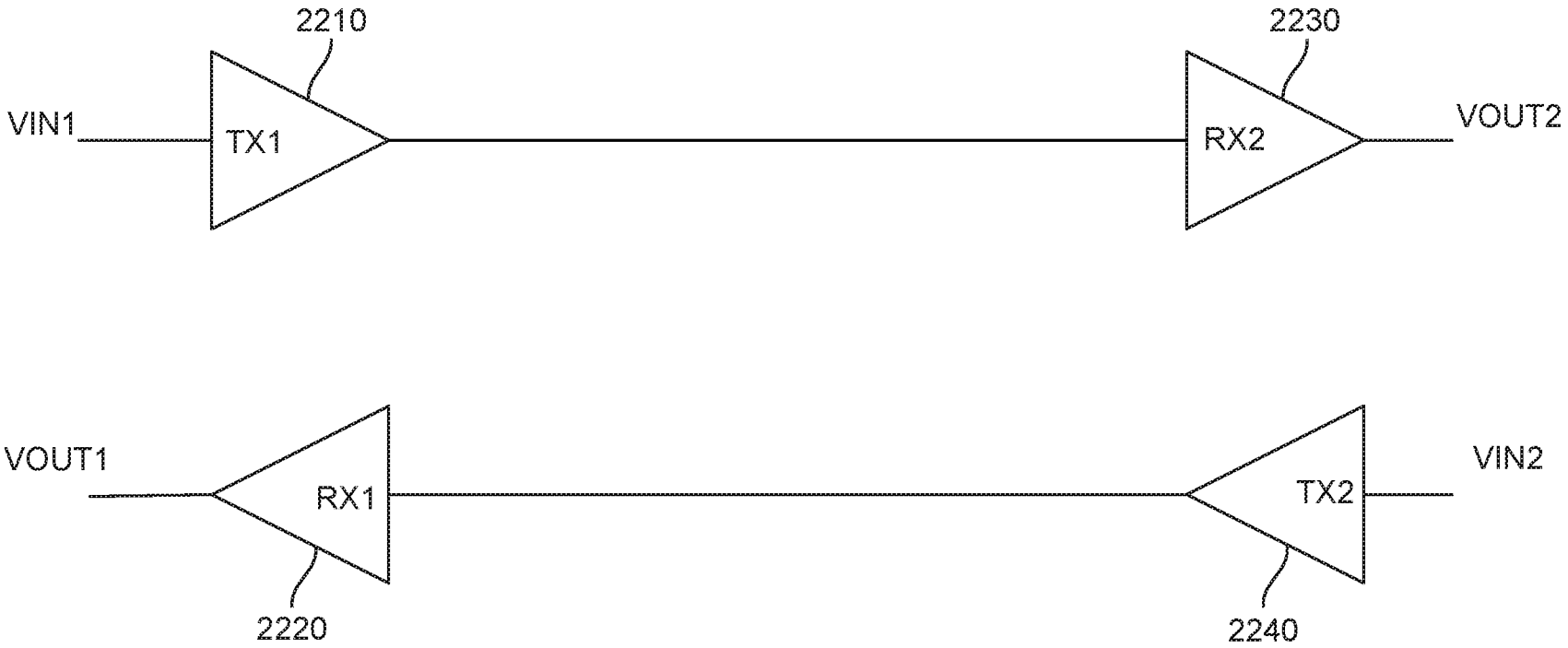
FIG. 22 illustrates a portion of a cable according to an embodiment of the present invention.

FIG. 22 illustrates a portion of a connector according to an embodiment of the present invention. In this example, the connector portion may be a portion of a connector insert or a connector receptacle. For example, this circuitry may be included in a connector insert that may be inserted into a connector receptacle of a first electronic device. The connector insert may be connected to a cable that is connected to a second electronic device via a second connector. In this example, data may be transmitted through the connector over a first signal path from the first electronic device to the second electronic device via transmitter circuitry TX1 2210 and receive circuitry RX2 2230. Similarly, data may be sent from the second electronic device to the first electronic device over a second signal path via transmitter TX2 2240 and receiver RX1 2220. Transmitters TX1 2210 and TX2 2240 may have adjustable gains. Other transmitters in the first and second electronic devices may also have gains that may be adjusted using these and other embodiments of the present invention. In these and other embodiments of the present invention, the circuitry shown in this connector insert may instead be in the first electronic device. In this and other examples here, the data paths are shown as a single line, though typically these may be differential signals or pseudo-differential signals.

The signals may couple to each other in the connector insert. In one example, transmitter TX1 2210 may provide a large amplitude to receiver RX2 2230. Conversely, transmitter TX2 2240 may provide a relatively low amplitude signal to receiver RX1 2220. The coupling between these signals may cause a signal-to-noise ratio of the second signal path to be reduced more than the signal-to-noise ratio of the first signal path. This may be caused by transmitter TX1 2210 providing a large amplitude signal, which may degrade the signal received by receiver RX1 2220. Conversely, the signal provided by transmitter TX2 2240 may not degrade the signal received at RX2 2230 to the same extent, since it has a lower-amplitude. Accordingly, the amplitude of the signal provided by transmitter TX1 2210 may be reduced. While this reduction may decrease the signal-to-noise ratio at receiver RX2 2230, overall system performance may be improved as the signal-to-noise ratio of the signal received at receiver RX1 2220 is improved.

In this example, the second electronic device may measure the signal amplitude at VOUT2 and send amplitude information back to the first electronic device using the second signal path via transmitter TX2 2240 and receiver RX1 2220. The first electronic device may measure the received strength at VOUT1 and may receive information regarding the received strength at VOUT2, and determine whether an adjustment to the signal amplitude of transmitter TX1 2210 is needed. In reversed situations where the amplitude at RX1 2220 is higher than RX2 2230, the first electronic device may send instructions to the second electronic device adjust the amplitude of the signal provided by transmitter TX2 2240. The first electronic device and the second electronic device may share amplitude or other signal parameter data using the first signal path or the second signal path. In these and other embodiments of the present invention, other signal paths, such as a low-speed data path may be used. For example, a universal asynchronous receiver-transmitter (UART) or other low-speed signal path may be used. These signal paths may transmit data at 10 Mbps or other appropriate data rate. These same or similar concepts may be applied where the nearby or adjacent signals are both transmitters, both receivers, or any combination thereof. By adjusting the amplitude of one or more signals, the signal-to-noise ratios for two or more channels may be balanced. This may help to improve overall system performance by ensuring that one channel does not have a very high signal-to-noise ratio at the expense of a signal-to-noise ratio for another channel. In these and other embodiments of the present invention, amplitude may be measured and adjusted to balance the signal-to-noise ratios. In these and other embodiments of the present invention, other parameters, such as received eye width, eye height, eye area, bit error rate, or other parameter may be measured and adjusted to balance the signal-to-noise ratios.

In these and other embodiments of the present invention, circuitry in any or all of the first electronic device, the second electronic device, the connector insert, or a second connector insert may measure an amplitude of a signal. For example, the first electronic device may include circuitry to measure an amplitude or other signal parameter of the VIN1 signal that it provides. It may also measure the received amplitude or other signal parameter of VOUT1. The connector insert may include circuitry to measure the amplitude or other signal parameter of any of VIN1, VOUT1, VIN2 or VOUT2. The second electronic device may include circuitry to measure an amplitude or other signal parameter of the VIN2 signal that it provides. It may also include circuitry to measure the received amplitude or other signal parameter of VOUT2. The connector insert may include circuitry to measure the amplitude or other signal parameter of any of VIN2, VOUT2, VIN1, or VOUT1. Again, in these and other embodiments of the present invention, the signal strength may be determined using amplitude or eye height, eye width, eye opening, eye area, bit error rate, or other signal characteristic. Once these amplitudes or other signal parameters have been measured, they may be used or provided to any or all of the first electronic device, the second electronic device, or the connector inserts, which may adjust the amplitude or other signal characteristic or parameter of one or more signals in order to balance the signal-to-noise ratios of two or more signal paths. In these and other embodiments of the present invention, these signals may be adjusted to balance the bit-error rate for each signal path. In these and other embodiments of the present invention, these signals may be adjusted to balance the eye size or area for received signals in each signal path.

Figure 23:
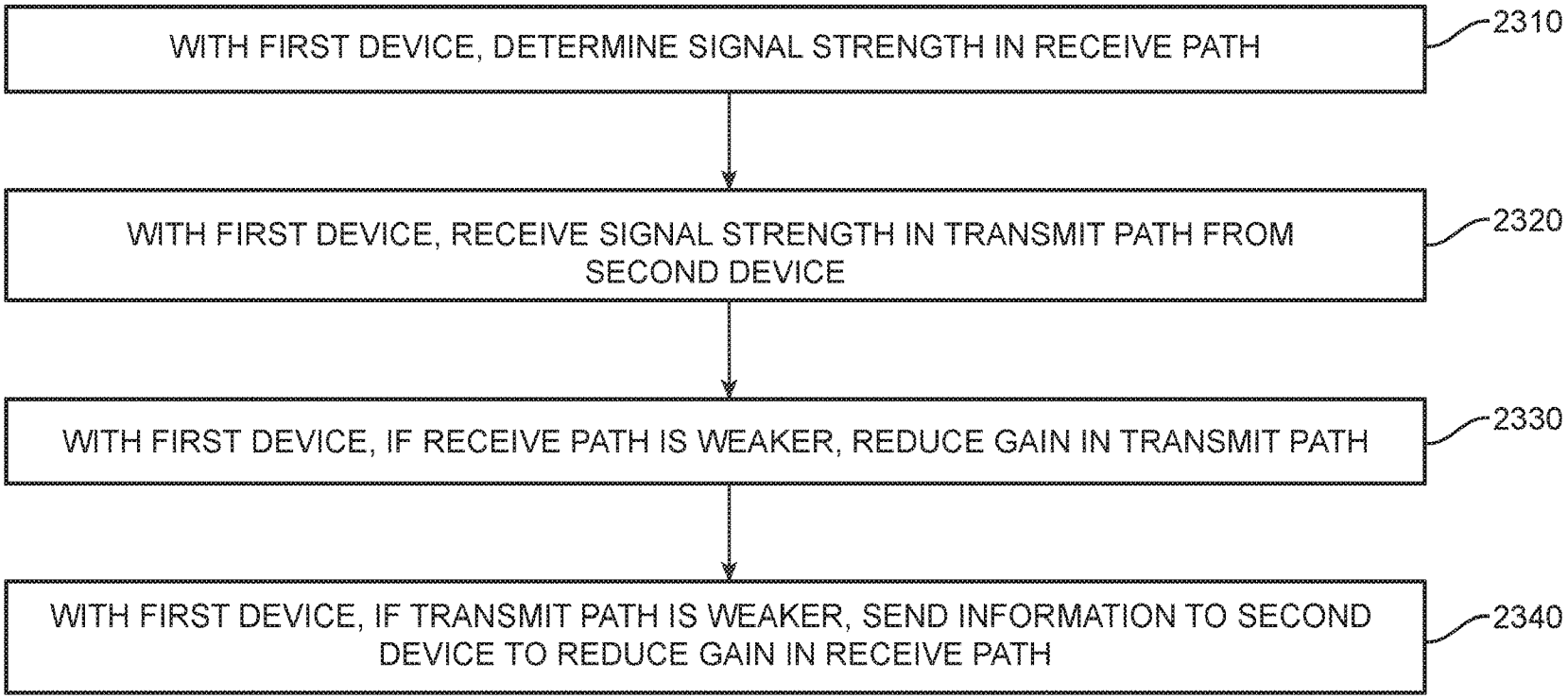
FIG. 23 is a method of operation for the circuitry of FIG. 22.

FIG. 23 is a method of operation for the circuitry of FIG. 22. In act 2310, with the first device, a signal strength in a receive path is determined. With the first device, a receive signal strength in a transmit path may be received from a second device in act 2320. If the receive path is weaker, gain in a transmit path may be reduced accordingly in act 2330. If the transmit path is weaker, information may be sent to the second device to reduce the gain in the receive path (the second device's transmit path) in act 2340. In these and other embodiments of the present invention, a signal strength may be determined by measuring amplitude or eye height, eye width, eye opening, eye area, bit error rate, or other signal characteristic. In these and other embodiments of the present invention, these signals may be adjusted to balance the signal-to-noise ratio for each signal path. In these and other embodiments of the present invention, these signals may be adjusted to balance the bit-error rate for each signal path. In these and other embodiments of the present invention, these signals may be adjusted to balance the eye size or area for received signals in each signal path.

Again, it may be desirable for a ground plane in a connector receptacle tongue to form a direct or nearly direct electrical connection to a ground plane in a corresponding connector insert. An example of how this may be done is shown in the following figure.

Figure 24:
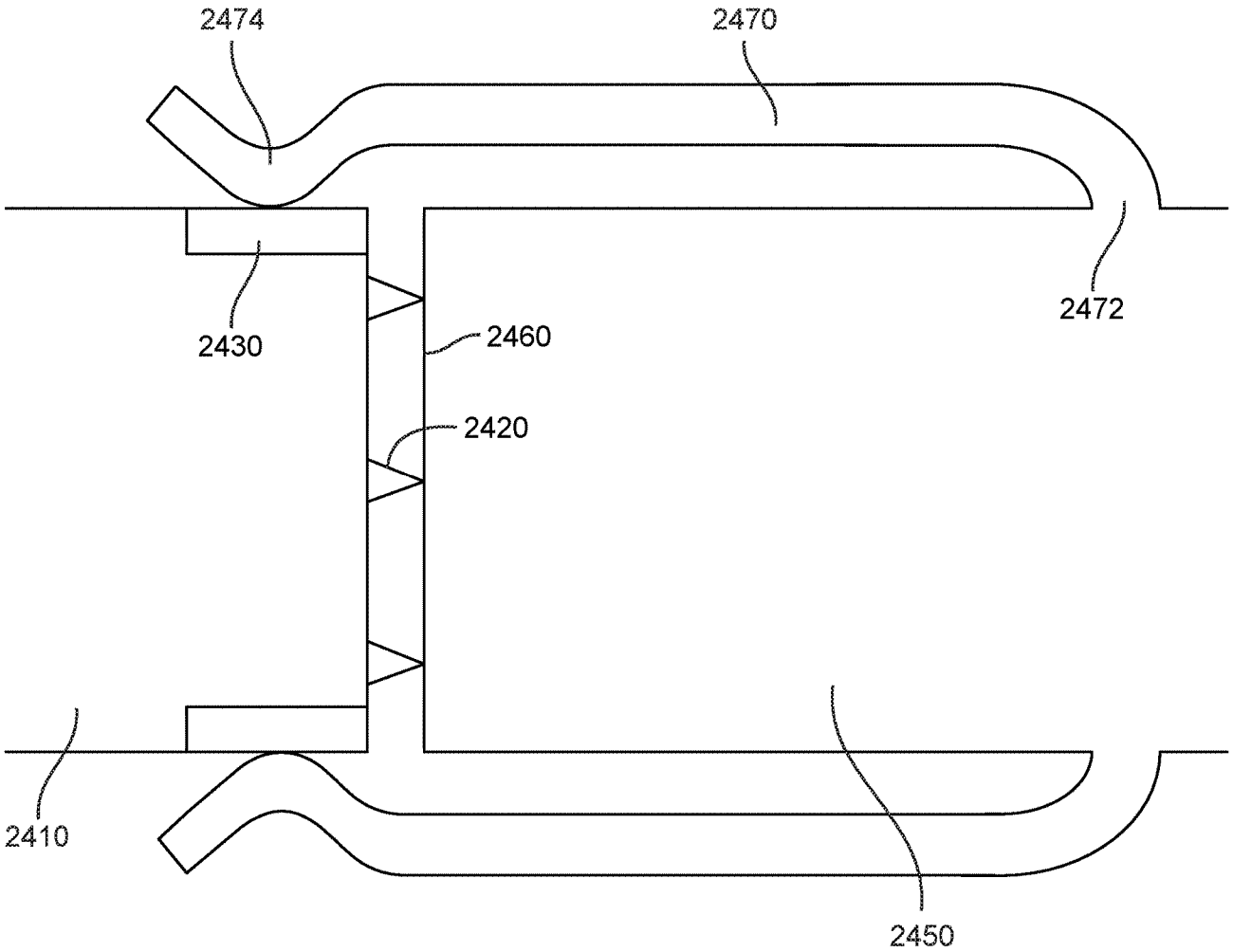
FIG. 24 illustrates a connector system according to an embodiment of the present invention.

FIG. 24 illustrates a portion of a connector system according to an embodiment of the present invention. In this example, a connector receptacle tongue 2410 may have a central or other ground plane in electrical contact with a central or other ground plane in a connector insert portion 2450. At least a portion of a front surface or leading edge of a ground plane 2460 of a connector insert portion 2450 may be exposed. This exposed portion of ground plane 2460 may be in electrical contact with protrusions 2420, which may extend from a ground plane (not shown) in connector receptacle tongue 2410. The protrusions 2420 and front surface or leading edge of ground plane 2460 may form an electrical connection, thereby connecting the ground planes to each other.

In these and other embodiments of the present invention, a ground plane 2460 in connector insert portion 2450 may be connected to ground contacts 2470. Ground contacts 2470 may connect to ground plane 2460 at points 2472. When mated with a corresponding connector receptacle, contacting portions 2474 of ground contacts 2470 may electrically connect to ground pins 2430 on connector receptacle tongue 2410. Ground contacts 2470 may also be used as a high or radio frequency ground return. Contacts 2470 may be plated with nickel to increase resistance at high frequency (such as 10 GHz) which may lower the Qualify factor (Q) of any resonant structure of which it is an element. This lower Q may provide lower peak currents and reduced coupling. Ground pins 2430 may be electrically connected to the ground plane in connector receptacle tongue 2410. Again, in these examples, only a portion of a connector system may be shown. Other structures, such as contacts on the tongue, housings around the tongue, and other structures may be included. For example, structures common to a connector system such as a USB type-C connector may be included, and these figures may show only a portion of the connectors.

In these and other embodiments of the present invention, instead of (or in conjunction with) forming a connection between ground planes in the connector receptacle tongue 2410 and ground plane 2460 in connector insert portion 2450, a front edge of connector insert portion 2450 and a front edge of connector receptacle tongue 2410 may be plated with a high permeability material. This material may be plated with a high permeability material having a low skin depth to provide a high impedance at high frequencies. Again, these edges may be connected to ground planes 2460 in connector insert portion 2450 and to a ground plane in connector receptacle tongue 2410. This plating may lower the quality or Q of a slot-transmission line that may be formed when the connector receptacle and connector insert are mated. That is, when the connectors are mated, a gap between front edges of connector receptacle tongue 2410 and connector insert portion 2450 may form a slot-transmission line. This gap may be open on each end and thus may resonate at frequency that is half a wavelength of the slot length. The low skin depth of the front edge plating may make the gap resistive at high frequency. This may lower the Q, which may lessen the coupling energy crossing slot-transmission line on the signal pins, which may reduce coupling among the signal pins. In these and other embodiments of the present invention, the high permeability material may be nickel, iron, or other material.

In these and other embodiments of the present invention, other portions of these connectors may be formed using a high permeability material such as nickel, iron, or other material. For example, ground plane 2460 in connector insert portion 2450 may be formed of a high permeability material. One or more ground planes (not shown) in connector receptacle tongue 2410 may be formed of a high permeability material. The isolation between pins on the top row and the bottom row of the connector tongue may be improved, as may the isolation between pins on the top row and the bottom row of the connector insert. In these and other embodiments of the present invention, these planes may also be connected to system grounds to reduce resonances that may otherwise occur. For example, ground pins (not shown) and ground plane 2460 in connector insert portion 2450 may be connected to a ground in a printed circuit board in the connector insert in a continuous or thorough manner to reduce resonances that may otherwise occur. For example, ground plane 2460 may be connected to a ground plane in a printed circuit board with contacts having a small spacing, such as 0.5 mm, 1.0 mm, 2.0 mm, or other spacing. Similarly, receptacle ground pins, such as ground pins 2430, and one or more ground planes in connector receptacle tongue 2410 may be connected to a ground in a printed circuit board in or connected to the connector receptacle in a continuous or thorough manner to reduce resonances that may otherwise occur.

The above configuration may improve common mode impedances and reduce ground loops by providing a connection between ground planes in a connector receptacle and a connector insert. In these and other embodiments of the present invention, other impedances through ground and power supply paths and impedances between ground and the power supplies may be reduced. Examples are shown in the following figure.

Figure 25:
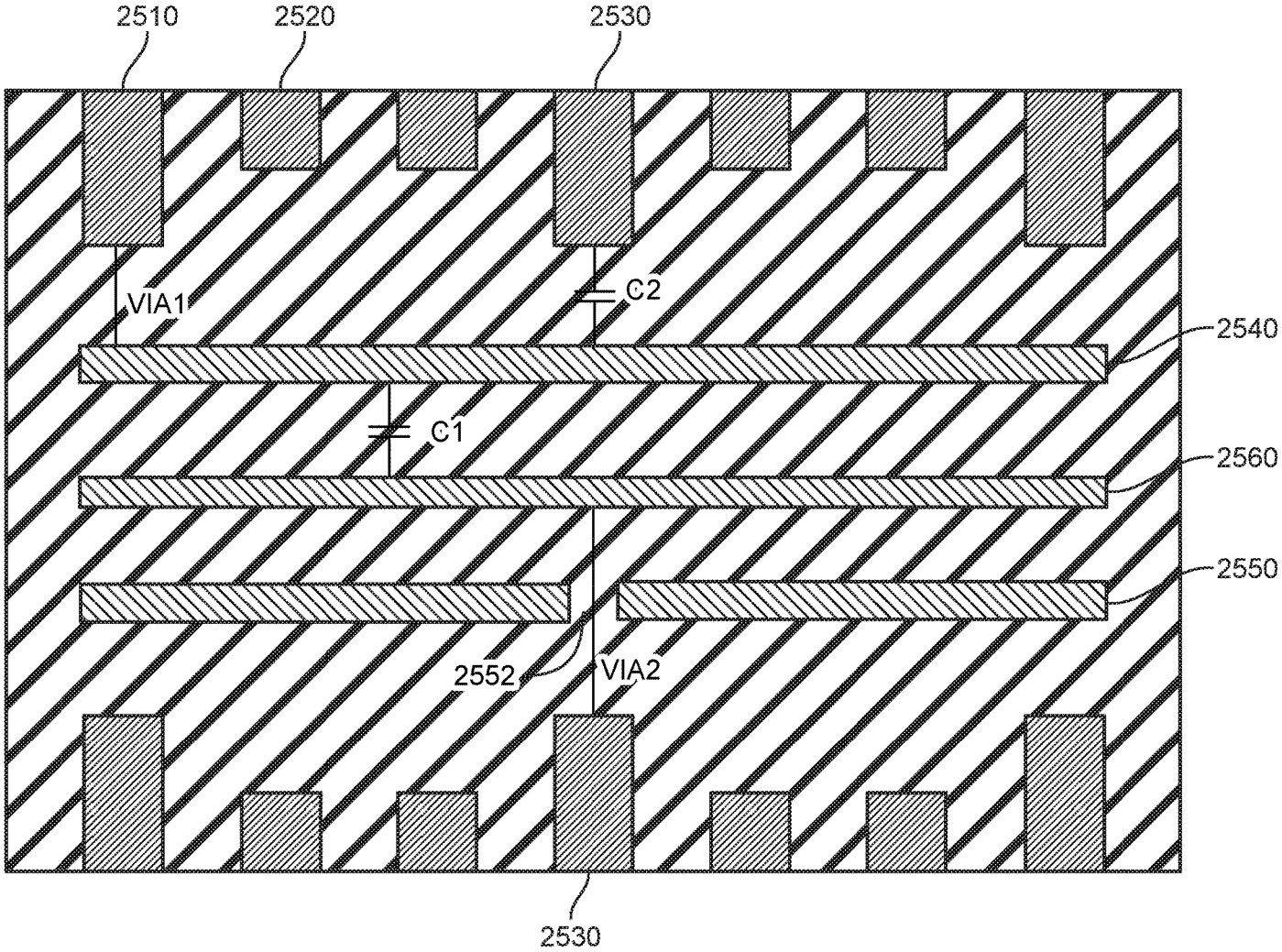
FIG. 25 illustrates a cutaway front view of a portion of a connector receptacle tongue according to an embodiment of the present invention.

FIG. 25 illustrates a cutaway front view of a portion of a connector receptacle tongue according to an embodiment of the present invention. This example may include ground contacts or pins 2510, signal contacts or pins 2520, and power contacts or pins 2530 along a top side of the tongue, and corresponding contacts along a bottom side of the tongue. Ground and power supply planes 2540, 2550, 2560 may also be included. An impedance between ground pin 2510 and ground plane 2540 may be reduced by the use of vias, illustrated here as VIA1. Similarly, an impedance between a power supply pin 2530 and a power supply plane 2560 may be reduced by the use of vias, illustrated here as VIA2. VIA2 may pass through an opening 2552 in ground plane 2550.

In these and other embodiments of the present invention, it may be further desirable to reduce in impedance between a power supply conveyed by power supply pin 2530 and ground conveyed by ground pin 2510. Accordingly, a capacitor C1 may be placed between ground plane 2540 and power supply plane 2560. Capacitor C1 may be an actual capacitor, a portion of capacitive material, or it may be a plate capacitance between ground plane 2540 and power supply plane 2560. Similarly, capacitor C2 may be located between power supply pin 2530 and ground plane 2540. As before, capacitor C2 may be an actual capacitor, a portion of capacitive material, or it may be plate capacitance between power supply pin 2530 and ground plane 2540.

In these and other embodiments of the present invention, a capacitor may be located between two or more of these power supply plane 2560 and ground planes 2540 and 2550. These capacitors may be connected to power supply pins 2530 and ground pins 2510 in various ways to improve performance. For example, the power supply plane 2560 and ground planes 2540 and 2550 may be connected with vias that may extend through the tongue in order to reduce series inductance. The vias may be interdigitated along their lengths, for example in grid pattern, where adjacent vias are connected to different potentials and cater-corner grids have the same potential.

In these and other embodiments of the present invention, it may be desirable for one or more of the ground pins 2510, signal pins 2520, and power pins 2530 to have significant coupling to the power supply plane 2560 and ground planes 2540 and 2550. This coupling may help to reduce the energy in resonant circuits of which they may be a part.

In these and other embodiments of the present invention, the coupling of ground pins and power pins to a plane, such as power supply plane or a ground plane, may be increased in various ways. For example, ground pins and power pins may be routed near a power or ground plane to increase a coupling between the pins and plane. In these and other embodiments of the present invention, one or more capacitive structures may be coupled between one or more power or ground pins and a power or ground plane. For example, a differential signal may be carried by a pair of signal pins. The signal pins may have adjacent power and ground pins. These power and ground pins may be coupled to a ground plane through corresponding capacitive structures.

In these and other embodiments of the present invention, the capacitive structures may be formed of a high-dielectric material that may be located between the pins and the plane. In these and other embodiments of the present invention, the capacitive structures may be actual capacitors, such as an electrolytic or ceramic capacitor, having terminals connected to the pins and the plane. A compliant conductive material may be used to form electrical connections between either or both a pin and a plane and the capacitor. More information on these capacitors, their possible locations, uses, and structure may be found in co-pending U.S. patent application Ser. No. 15/274,441, filed Sep. 23, 2016, which is incorporated by reference.

In these and other embodiments of the present invention, signal pins and other types of pins may also be routed near a ground or power plane to increase coupling. The same or similar capacitive structures may be located between the signal pins and a ground or power plane to increase coupling. The capacitive structures may be located in a connector receptacle tongue, connector receptacle housing, or elsewhere in a connector receptacle. In these and other embodiments of the present invention, the structures may be located in a connector insert housing or other connector insert portion.

These and other embodiments of the present invention may provide high-speed data paths. These high-speed data paths may be used to convey multiple lower speed signals. By conveying multiple lower speed signals over a single higher speed data path, the amount of circuitry and conductors that is needed may be reduced. An example is shown in the following figure.

Figure 26:
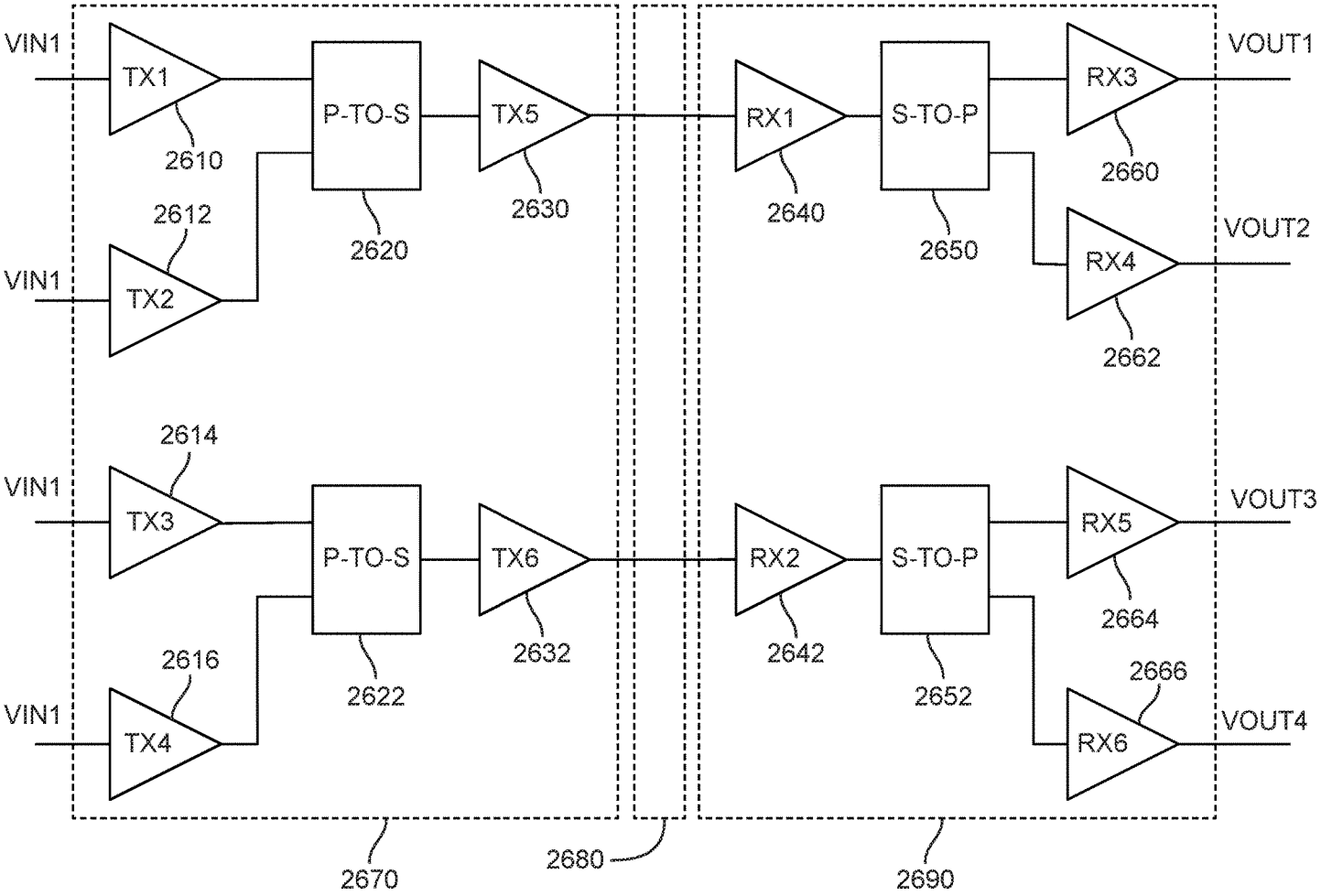
FIG. 26 illustrates a cable assembly according to an embodiment of the present invention.

FIG. 26 illustrates a cable assembly according to an embodiment of the present invention. In this example, first connector insert 2670 may communicate with second connector insert 2690 via cable 2680. First connector insert 2670 may be inserted into a corresponding connector receptacle of the first electronic device (not shown), while second connector insert 2690 may be inserted into a corresponding second electronic device (not shown). In this example, connector insert 2670 may receive four DisplayPort signals at transmitters TX1 2610, TX2 2612, TX3 2614, and TX4 2616. Pairs of DisplayPort data signals may be serialized by parallel-to-serial converters 2620 and 2622, and provided to transmit circuits TX5 2630 and TX6 2632. In this way, only two signals need to be conveyed through cable 2680, thereby reducing a number of conductors needed in cable 2680, as well as the number of transmitters and receivers needed to convey the signals through the cable. The two combined signals may be received at connector insert 2690 by receivers RX1 2640 and RX2 2 642. The output of these receivers may be converted back to parallel data by serial-to-parallel converters 2650 and 2652. Serial-to-parallel converters 2650 and 2652 may be clocked with a timing that de-interleaves the two data signals to the correct channels. The four parallel data signals may be provided to the second electronic device using receive circuits RX3 2660, RX4 2662, RX5 2664, and RX6 2666.

In this example, four parallel data signals are serialized into two parallel data signals. In these and other embodiments of the present invention, the four parallel data signals may be serialized into a single data signal. In these and other embodiments of the present invention, different numbers of signals may be received and serialized into different numbers of data signals. These and other embodiments of the present invention may be useful where signals are provided in a unidirectional manner. In these and other embodiments of the present invention, the connections through cable 2680 may be fiber optic connections. These connections may employ laser diodes and light detecting receivers that may use PIN or avalanche diodes, or other light sensing devices. This is in contrast to systems where either additional fiber optic channels are needed in the cable along with additional transmitters and receivers, as well as bidirectional systems where transmitters and receivers are needed on each fiber.

In these and other embodiments of the present invention, various signals may be repurposed as high-speed data signals in order to increase a data bandwidth of a connector system. An example is shown in the following figures.

Figure 27:
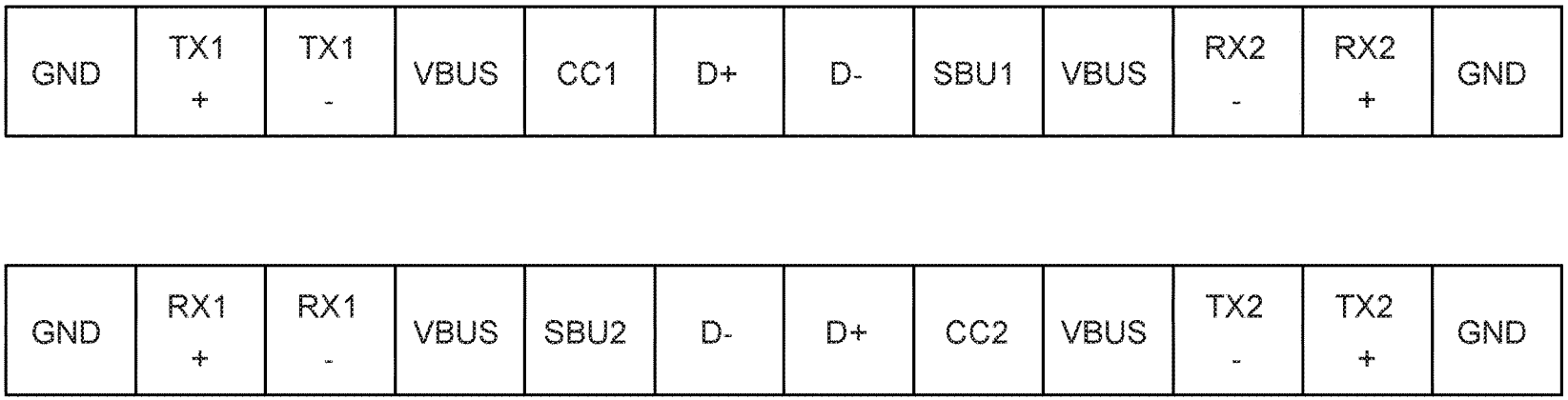
FIG. 27 illustrates a pinout for a USB type-C connector.

FIG. 27 illustrates a pinout for a USB type-C connector. In this example, the connector insert power pins SBU1 and SBU2 may be dual purposed as low speed power or signals and as high-speed data signals. Similarly, after a connection has been detected, or if a connection is detected using a different technique, connector detect pins CC1 and CC2 may be repurposed as high-speed data pins. Similarly, USB data pins D+ and D− may be repurposed or multi-purposed as high-speed data pins. In one example, the four of these pins along the top row of pins may be used to convey high-speed data signals, while the four of these pins in the bottom row of pins may also be used to convey high-speed data signals. In these and other embodiments of the present invention, any combination of these or other pins may be used to convey high-speed signals. In these and other embodiments of the present invention, three, five, six, seven, eight, or more than eight pins may be used.

In these and other embodiments of the present invention, various types of signals may be sent using these dual-purpose pins. Signal schemes that use of both the differential and common mode aspects of signals may be included. For example, an N conductor transmission line system may have N−1 pseudo-differential modes that may be orthogonal to each other. Each of these N−1 pseudo-differential modes or signals may be used to convey information. The common mode of these signals may also be used to convey information, for example as a low-speed signal.

Again, in these and other embodiments of the present invention, one or more groups of four pins may be multi-purposed as high-speed pins. These high-speed pins may convey signals that may be sent over the orthogonal eigen modes. One of these eigen modes may be a common mode, while the others may be variations of generalized case of differential signaling for higher wire counts than two. In these and other embodiments of the present invention, these four pins may be used to convey three pseudo-differential signals. In these and other embodiments of the present invention, different numbers of pins may be used to convey different numbers of signals. An example of how the USB data pins may be repurposed is shown in the following FIGURE.

Figure 28:
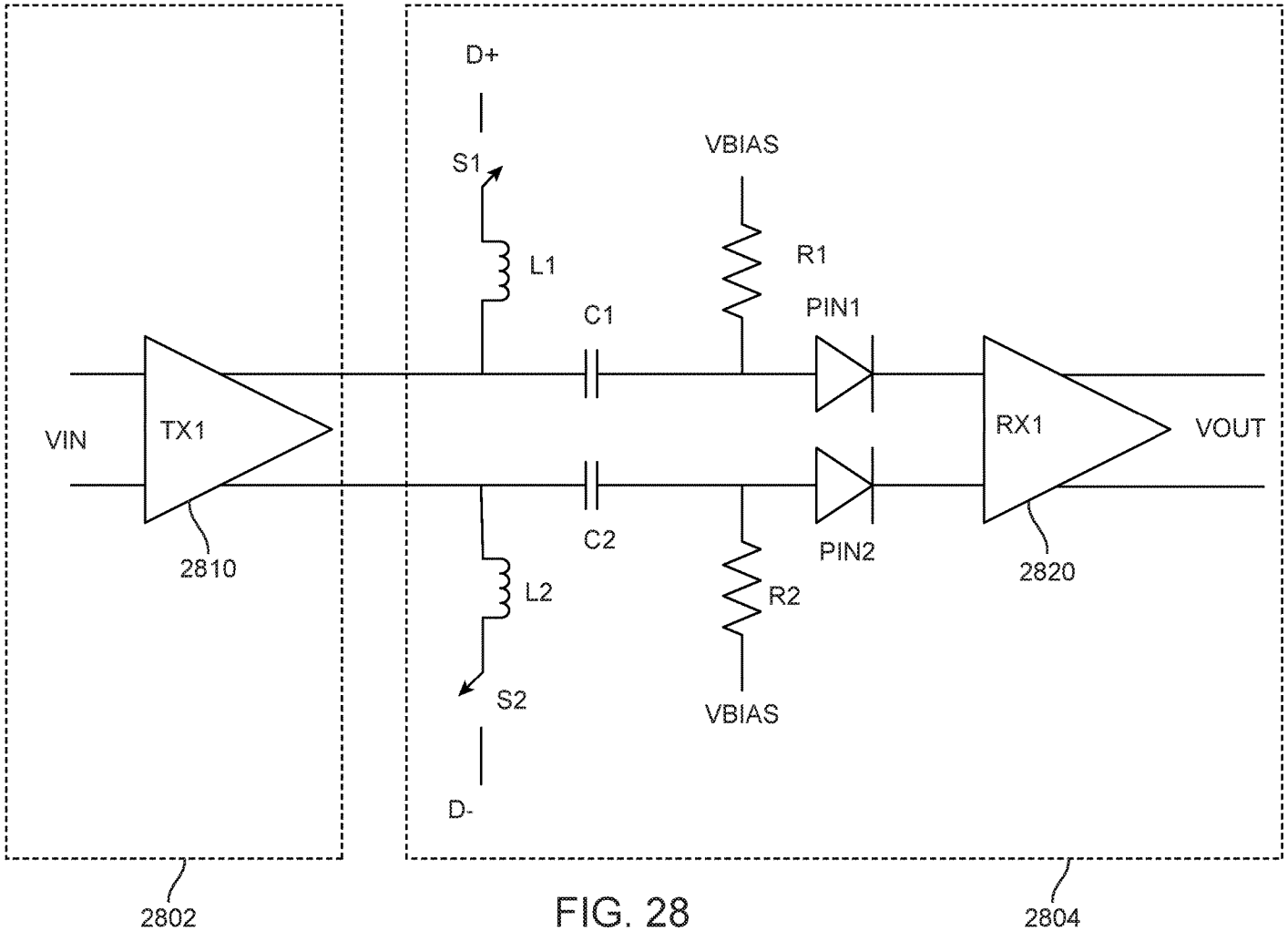
FIG. 28 illustrates circuitry to allow USB data pins to be repurposed as high-speed data pins.

FIG. 28 illustrates circuitry to allow USB data pins to be repurposed as high-speed data pins. In this example, an input signal may be received at transmitter TX1 2710, which may be located in electronic device 2802. Transmitter TX1 2710 may be coupled to circuitry in connector insert 2804. When the output of transmitter TX1 2710 is a high-speed signal, the VBIAS signal may forward bias pin diodes PIN1 and PIN2, allowing them to conduct, and switches S1 and S2 may open. The high-speed signals provided by transmitter TX1 2710 may then be received by receiver RX1 2720. Blocking inductors L1 and L2 may be located close to the signal path so as not to create stubs that may degrade high-frequency signal performance. When low-speed data is received by transmitter TX1 2710, switches S1 and S2 may close and VBIAS may return low, thereby causing pin diodes PIN1 and PIN2 to appear as open circuits. The low-speed data may pass through blocking inductors L1 and L2 and pass through closed switches S1 and S2, to be received as data signals D+ and D−. In these and other embodiments of the present invention, an analog or other suitable high-frequency multiplexer may replace at least inductors L1 and L2 and their switches S1 and S2, along with pin diodes PIN1 and PIN2, and their respective biasing resistors R1 and R2. The capacitors C1 and C2 may still be needed to decouple the signal from transmitter 2810. Resistors R1 and R2 may be needed to restore a DC level to the AC coupled signal.

Again, in these examples, only a portion of a connector system may be shown. Other structures, such as contacts on the tongue, housings around the tongue, and other structures may be included. For example, structures common to a connector system such as a USB type-C connector may be included, and these figures may show only a portion of the connectors.

In various embodiments of the present invention, contacts, ground planes, traces, and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connectors that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connectors may provide pathways for signals that are compliant with various standards such as Universal Serial Bus (USB) including USB-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connectors that may be used to provide a reduced set of functions for one or more of these standards. In various embodiments of the present invention, these interconnect paths provided by these connectors may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An electronic device comprising:

a universal serial bus type-C connector comprising a first plurality of contacts to convey a first plurality of signals and a second plurality of contacts to convey a second plurality of signals, each of the first plurality of contacts and each of the second plurality of contacts having a first area, the first plurality of contacts each having a first layer comprising a first material, the first layer over the first area, and a second layer over the first layer and comprising a second material, the second layer over the first area, and the second plurality of contacts each having a first layer comprising the first material, the first layer over the first area, and a second layer over the first layer and comprising the second material, wherein the second layer is absent from the first area, wherein the first material has a high permeability, a low impedance at low frequencies, and a high impedance at high frequencies, and wherein the second material has a low permeability, a low impedance at low frequencies, and a low impedance at high frequencies, wherein the permeability of the first material is higher than the permeability of the second material.

2. The electronic device of claim 1 wherein the first material has a shallow skin-depth.

3. The electronic device of claim 2 wherein the first material reduces the energy in a resonance formed by a first contact in the first plurality of contacts.

4. The electronic device of claim 2 wherein the first material reduces the quality (Q) of a resonance formed by a first contact in the first plurality of contacts.

5. The electronic device of claim 4 wherein the first material is nickel and the second material is gold.

6. The electronic device of claim 1 wherein the first plurality of signals comprises power supplies, and wherein the second plurality of signals comprises high-speed signals.

7. The electronic device of claim 1 wherein the electronic device is a portable computer.

8. The electronic device of claim 1 wherein the electronic device is a cable.

9. The electronic device of claim 1 wherein the electronic device is a smartphone.

10. The electronic device of claim 1 wherein the universal serial bus type-C connector is a connector receptacle.

11. The electronic device of claim 1 wherein the universal serial bus type-C connector is a connector insert.

12. An electronic device comprising:

a universal serial bus type-C connector comprising a first plurality of contacts and a second plurality of contacts, each of the first plurality of contacts and each of the second plurality of contacts having a first area, the first plurality of contacts and the second plurality of contacts each having a first layer comprising a first material and a second layer comprising a second material, the second layer over the first layer, wherein the second layer is present in the first area of each of the first plurality of contacts and the second layer is absent from the first area of each of the second plurality of contacts, wherein the first material has a high permeability, a low impedance at low frequencies, and a high impedance at high frequencies, and wherein the second material has a low permeability, a low impedance at low frequencies, and a low impedance at high frequencies, wherein the permeability of the first material is higher than the permeability of the second material.

13. The electronic device of claim 12 wherein the first plurality of contacts convey power supplies and a second plurality of contacts convey high-speed signals.

14. The electronic device of claim 12 wherein the electronic device is a portable computer.

15. The electronic device of claim 12 wherein the electronic device is a cable.

16. The electronic device of claim 12 wherein the electronic device is a smartphone.

17. The electronic device of claim 12 wherein the universal serial bus type-C connector is a connector receptacle.

18. The electronic device of claim 12 wherein the universal serial bus type-C connector is a connector insert.

19. The electronic device of claim 12 wherein the first material is nickel and the second material is gold.

* * * * *